US010953676B2

(12) United States Patent
Maeda

(10) Patent No.: US 10,953,676 B2
(45) Date of Patent: Mar. 23, 2021

(54) PRINTER

(71) Applicant: SATO HOLDINGS KABUSHIKI KAISHA, Tokyo (JP)

(72) Inventor: Hideyuki Maeda, Tokyo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/607,818

(22) PCT Filed: Sep. 25, 2018

(86) PCT No.: PCT/JP2018/035517
§ 371 (c)(1),
(2) Date: Oct. 24, 2019

(87) PCT Pub. No.: WO2019/187230
PCT Pub. Date: Oct. 3, 2019

(65) Prior Publication Data

US 2020/0198381 A1 Jun. 25, 2020

(30) Foreign Application Priority Data

Mar. 30, 2018 (JP) ..... JP2018-068318

(51) Int. Cl.

| | |
|---|---|
| ***B41J 29/02*** | (2006.01) |
| ***B41J 15/04*** | (2006.01) |
| ***B65H 16/06*** | (2006.01) |
| ***B65H 19/12*** | (2006.01) |

(52) U.S. Cl.
CPC ..... *B41J 29/02* (2013.01); *B41J 15/04* (2013.01); *B41J 15/042* (2013.01); *B65H 16/06* (2013.01); *B65H 19/12* (2013.01)

(58) Field of Classification Search
CPC . B41J 15/04; B41J 15/042; B41J 29/02; B41J 29/13; B65H 16/06; B65H 19/12
See application file for complete search history.

(56) References Cited

U.S. PATENT DOCUMENTS 6,431,492 B1 * 8/2002 Chillscyzn ..... B41J 15/042 242/577
8,882,374 B2 * 11/2014 Colonel ..... B41J 3/4075 400/613
9,126,438 B2 * 9/2015 Uchino ..... B41J 3/4075
(Continued)

FOREIGN PATENT DOCUMENTS

JP 2008-87861 A 4/2008
JP 2018-43810 A 3/2018

*Primary Examiner* — Anh T Vo
(74) *Attorney, Agent, or Firm* — Foley & Lardner LLP

(57) ABSTRACT

Including a pair of support members sandwiching a roll-like print medium and a pair of swing members each including a holding pin for rotatably holding the print medium, mounted on the support member, capable of swing, respectively, and swinging in the direction where the pair of holding pins gets closer to each other by being brought into contact with the print medium, the swing member being mounted at a position biased to a taking-out direction side of the print medium in the support member and a length of the swing member in a swing radial direction being smaller than a length of the support member in a taking-in/out direction of the print medium.

6 Claims, 26 Drawing Sheets

(56) References Cited

U.S. PATENT DOCUMENTS

2008/0135647 A1* 6/2008 France ..... A01G 27/005
239/542
2012/0141183 A1* 6/2012 Kubota ..... B41J 15/042
400/194

* cited by examiner

PRINTER

TECHNICAL FIELD

The present invention relates to a printer.

BACKGROUND ART

Conventionally, an art of holding a print medium in which a swing member is brought into contact with the print medium and swings, and a holding pin enters into a tubular material of the print medium when a roll-like print medium is loaded has been known (see JP2008-87861A).

SUMMARY OF INVENTION

However, in the prior art, when the print medium with a small inner diameter of the tubular material or a print medium with a small remaining amount is to be loaded, the operation of causing the holding pin to enter into the tubular material as above cannot be performed, and loading/holding of the print medium cannot be accomplished in some cases.

Thus, an aspect of the present invention has an object of providing a printer capable of loading and holding of a print medium regardless of a diameter of the print medium and a diameter of the tubular material of the print medium.

According to the one aspect of the present invention, a printer including a pair of support members nipping a roll-like print medium and a pair of swing members including a holding pin for rotatably holding the print medium, mounted on the support members, respectively, capable of swing, and swinging in a direction where the pair of holding pins get closer to each other by abutting to the print medium, in which the swing member is mounted at a position biased to a taking-out direction side of the print medium in the support member, and a length of the swing member in a swing radius direction is smaller than a length of the support member in the bringing-in/taking-out direction of the print medium is provided.

According to the one aspect of the present invention, the print medium can be loaded and held regardless of a diameter of the print medium and a diameter of the tubular material of the print medium.

BRIEF DESCRIPTION OF DRAWINGS

FIG. 24-1 is a view illustrating an operation of the swing member 70 when the print medium M (sheet) is to be taken out of the roll guide 60 and illustrates a state when the print medium M (sheet) abuts to an inclined surface 751.

FIG. 24-2 is a view illustrating the operation of the swing member 70 when the print medium M (sheet) is to be taken out of the roll guide 60 and illustrates a state when the inclined surface 751 receives a force from the print medium M (sheet), and the swing member 70 swings in a direction where a pair of holding pins 78 gets closer to each other by using a wedge effect of the inclined surface 751.

FIG. 24-3 is a view illustrating the operation of the swing member 70 when the print medium M (sheet) is to be taken out of the roll guide 60 and illustrates a state when the print medium M (sheet) abuts to the holding pin 78, whereby the swing member swings in the direction where the pair of holding pins 78 are separated from each other.

DESCRIPTION OF EMBODIMENTS

[Entire Structure of Printer 100]

A printer 100 according to an embodiment of the present invention will be described below by referring to the attached drawings.

The printer 100 is a thermal transfer type in which an ink ribbon R is heated so as to transfer an ink of the ink ribbon R to a print medium M for printing. The print medium M is a label continuous body in which a plurality of labels is temporarily attached continuously at a predetermined interval to a band-like liner sheet, for example, and is wound in a roll state around a tubular material P as illustrated in FIG. 2.

Figure 1:
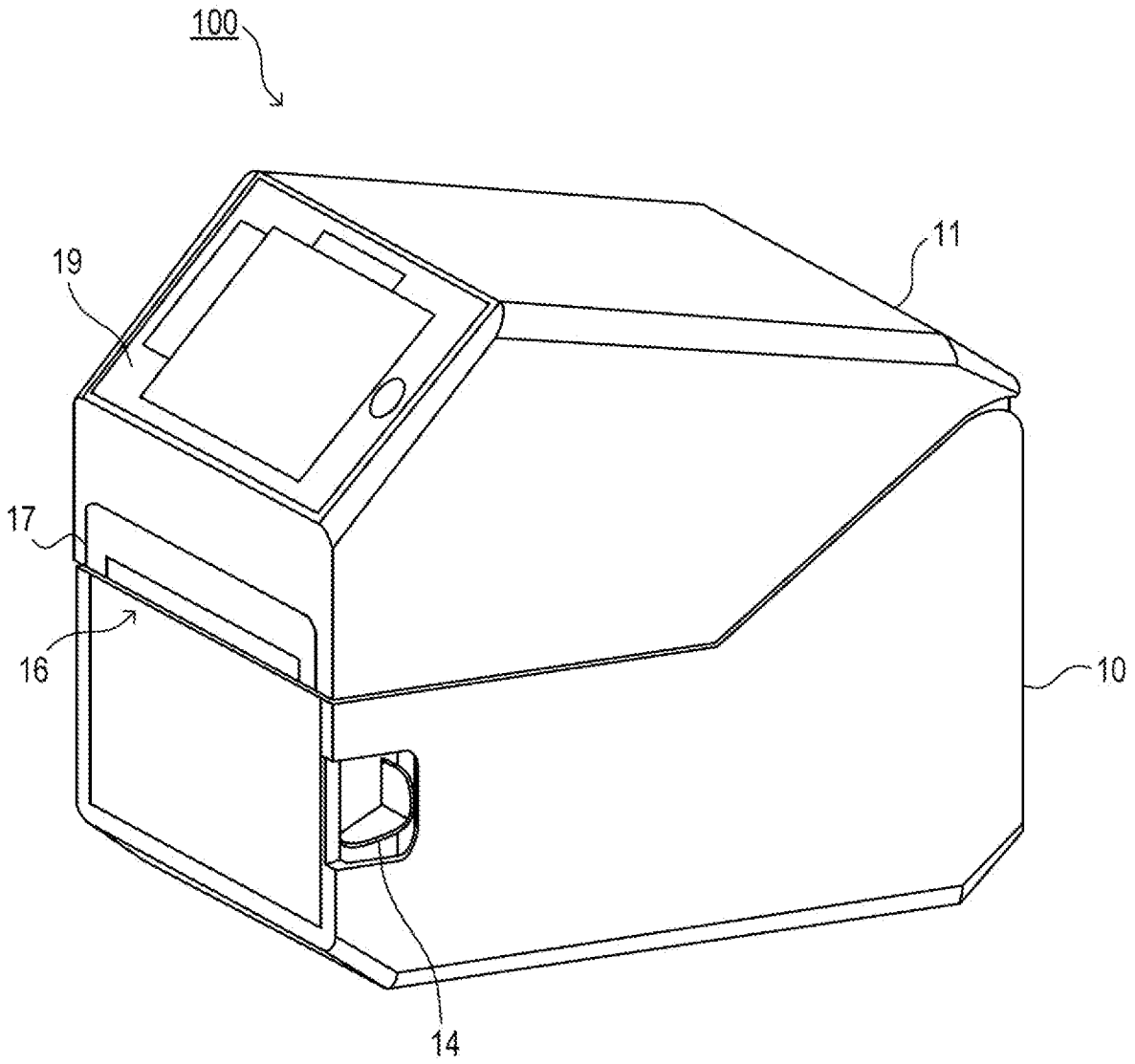
FIG. 1 is a perspective view of a printer 100 according to an embodiment of the present invention.
Figure 2:
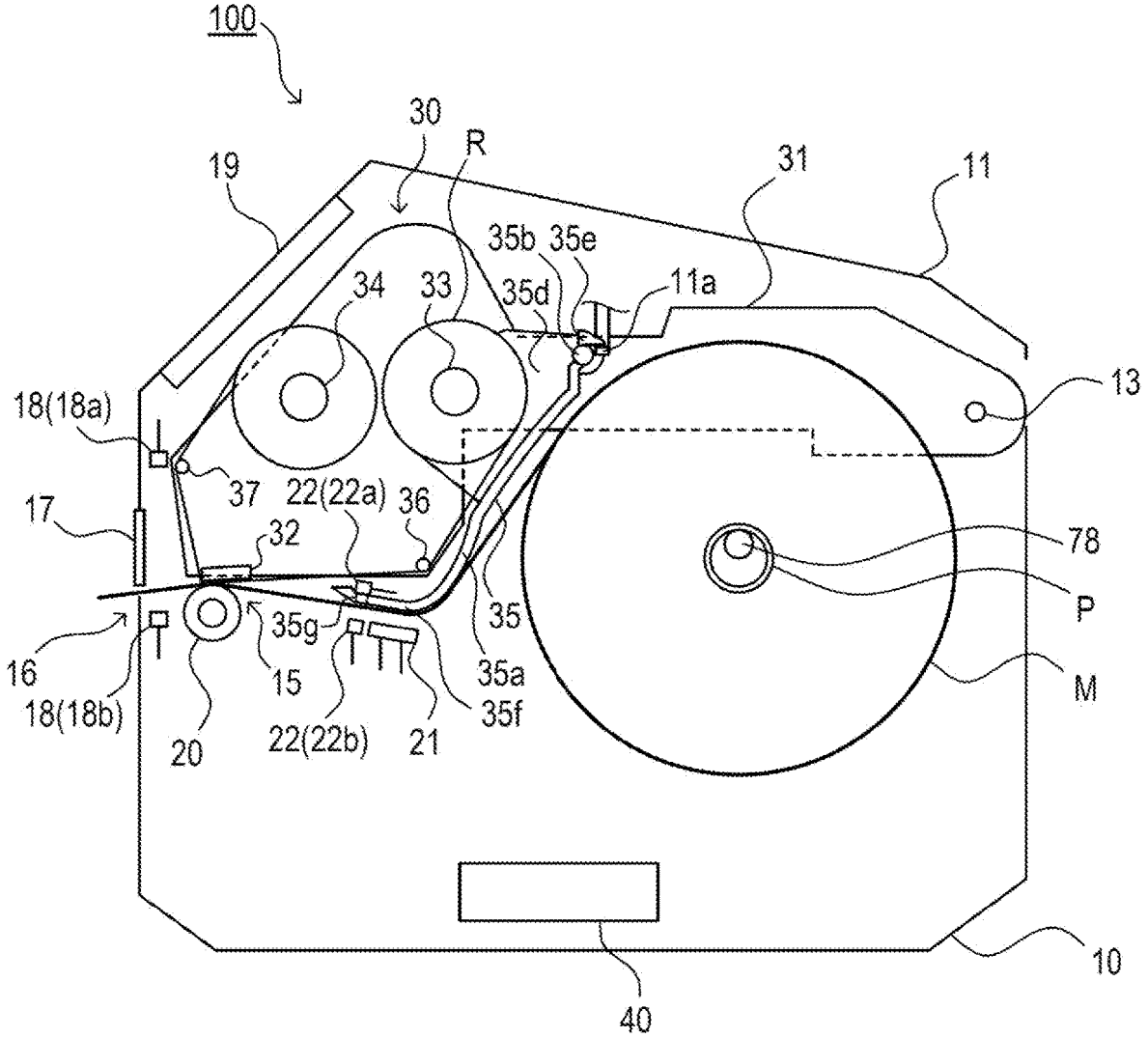
FIG. 2 is a schematic configuration diagram of the printer 100 according to the embodiment of the present invention.

The printer 100 includes a housing 10 and a cover 11 covering an opening portion of the housing 10 as illustrated in FIGS. 1 and 2.

The print medium M is held by a holding pin 78 entering into the tubular material P as illustrated in FIG. 2. A linerless label can be also used as the print medium M.

The cover 11 has an end portion on one end side supported by a support shaft 13 provided on the housing 10, capable of swing. The cover 11 can be switched between an open state (see FIG. 3) where the opening portion of the housing 10 is open and a closed state (see FIG. 2) where it is closed by being caused to swing with the support shaft 13 as a fulcrum.

A lock mechanism (not shown) for maintaining the cover 11 in the closed state is provided on the housing 10. The lock mechanism is unlocked by operating a lever 14 illustrated in FIG. 1.

A discharge port 16 through which the print medium M printed in a print portion 15 illustrated in FIG. 2 is discharged from the printer 100 is formed between an end portion on the other end side of the cover 11 and the housing 10.

A cutter 17 facing the discharge port 16 is mounted on the cover 11. As a result, the print medium M having been printed and discharged from the discharge port 16 can be cut. Other various units may be mounted on the cover 11 instead of the cutter 17.

A transmission sensor 18 for detecting presence of the print medium M is provided between the discharge port 16 and the print portion 15.

The transmission sensor 18 is an optical sensor having a light emitting unit 18*a* which emits predetermined light and a light receiving unit 18*b* which receives the light emitted from the light emitting unit 18*a* and outputs an electric signal corresponding to intensity of the received light.

When the print medium M is present between the light emitting unit 18*a* and the light receiving unit 18*b*, the light emitted from the light emitting unit 18*a* is shielded, and the intensity of the light received by the light receiving unit 18*b* is lowered.

As a result, the transmission sensor 18 can detect presence of the print medium M. Positions of the light emitting unit 18*a* and the light receiving unit 18*b* may be switched.

Moreover, an operation unit 19 for operating the printer 100 is provided on the cover 11. The operation unit 19 has various operation buttons, a display, a near-distance wireless communication module, an LED and the like. The display may be a touch panel.

A print unit 30 for printing on the print medium M, a controller 40 for controlling an operation of the printer 100 and the like are accommodated inside the printer 100 as illustrated in FIG. 2.

The print unit 30 includes a body portion 31 having one end side supported by the support shaft 13, capable of swing, and a thermal head 32 mounted on the body portion 31.

The thermal head 32 constitutes the print portion 15 for printing on the print medium M together with a platen roller 20 provided on the housing 10 side.

The print unit 30 is made capable of swing between a print position (see FIG. 2) where the print medium M is nipped between the thermal head 32 and the platen roller 20 and a non-print position (see FIGS. 3 and 4) where the thermal head 32 is separated from the platen roller 20.

Moreover, the print unit 30 includes a ribbon supply shaft 33 for holding the ink ribbon R supplied to the print portion 15 in the roll state, a ribbon roll-up shaft 34 for rolling up the used ink ribbon R, a partition member 35 for partitioning the ink ribbon R from the print medium M, a guide shaft 36 for regulating a feed path of the ink ribbon R from the ribbon supply shaft 33 to the print portion 15, and a guide shaft 37 for regulating a feed path of the ink ribbon R from the print portion 15 to the ribbon roll-up shaft 34. The ribbon supply shaft 33 is detachably attached to the partition member 35.

The print medium M is supplied to the print portion 15 from the position held by the holding pin 78 and is nipped together with the ink ribbon R between the thermal head 32 and the platen roller 20.

If a heating element of the thermal head 32 is electrically conducted in a state where the print medium M and the ink ribbon R are nipped between the thermal head 32 and the platen roller 20, that is, when the print unit 30 is at the print position, the ink of the ink ribbon R is transferred to the print medium M by a heat of the heating element, and the print medium M is printed.

Moreover, when the platen roller 20 is rotated forward by a platen driving motor (not shown), the print medium M and the ink ribbon R are fed to a downstream side in a feeding direction, and the print medium M is discharged to an outside of the printer 100 through the discharge port 16.

Moreover, the ribbon supply shaft 33 and the ribbon roll-up shaft 34 are also rotated/driven by driving motors (not shown), respectively.

The partition member 35 has a base portion 35*a*, a shaft portion 35*b* provided on one end side of the base portion 35*a*, a support portion 35*d* supporting the ribbon supply shaft 33 in parallel with the shaft portion 35*b* and rotatably, and an engaging portion 35*e* formed at a center part of the shaft portion 35*b*.

The partition member 35 is supported on the body portion 31, capable swing by the shaft portion 35*b*.

The engaging portion 35*e* is constituted so as to be engaged with an engaged portion 11*a* provided on the cover 11 as illustrated in FIG. 2. By bringing the partition member 35 to a position (closed position) where the engaging portion 35*e* is engaged with the engaged portion 11*a*, the ribbon supply shaft 33 is accommodated in the body portion 31. As a result, the ribbon supply shaft 33 is brought to a ribbon supply position where the ink ribbon R is supplied to the print portion 15.

As described above, the partition member 35 is maintained at the closed position where the ribbon supply shaft 33 is at the ribbon supply position by means of engagement between the engaging portion 35*e* and the engaged portion 11*a*. Moreover, the print unit 30 and the cover 11 are brought into a connected state.

When printing is to be performed by the printer 100, the cover 11 is brought to the closed state, and the engaging portion 35*e* of the partition member 35 and the engaged portion 11*a* of the cover 11 are brought into the engaged state.

Figure 3:
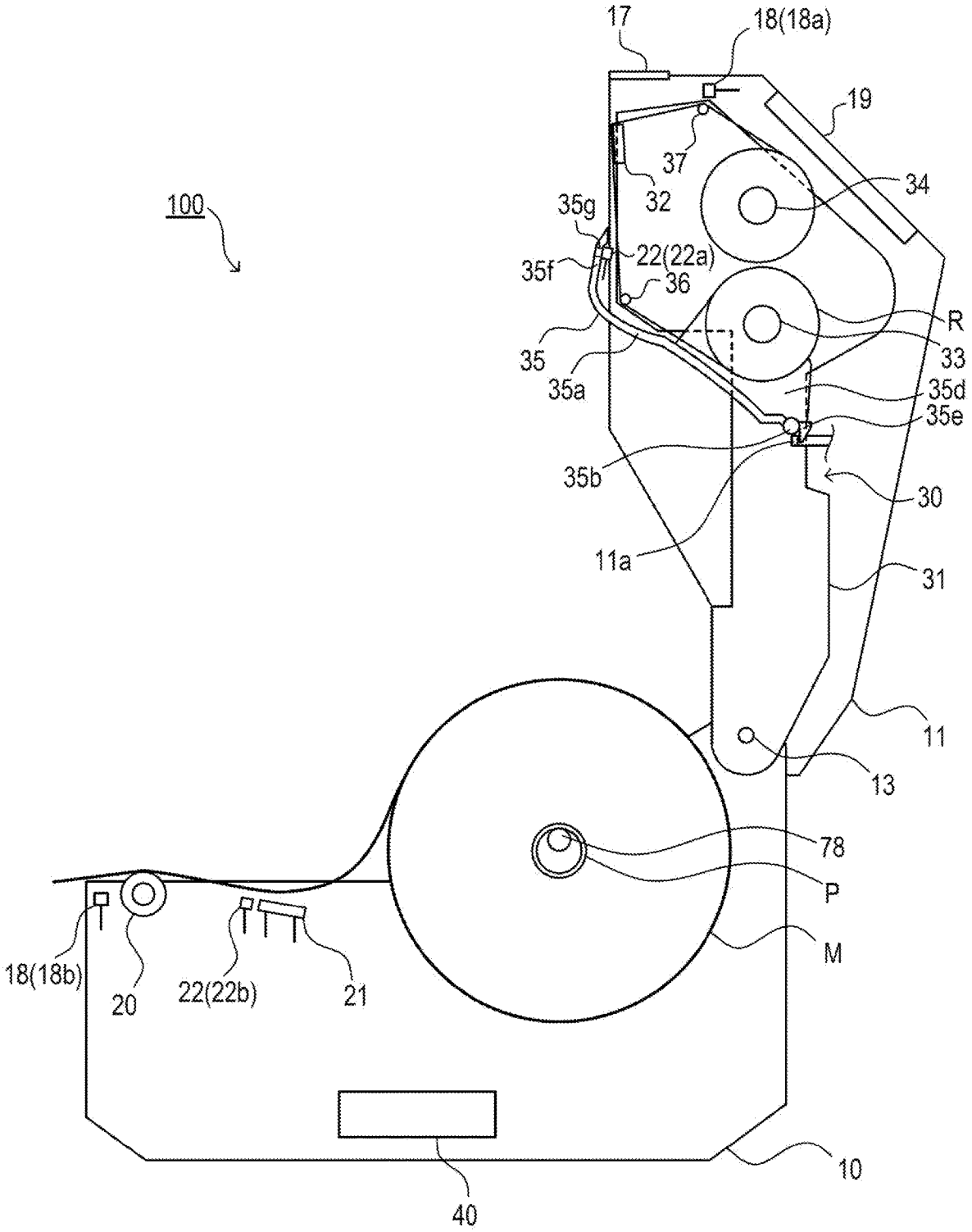
FIG. 3 is a diagram showing a state where a cover 11 is open.

Thus, when the cover 11 is switched from the closed state to the open state, the print unit 30 swings integrally with the cover 11, and the opening portion of the housing 10 is opened as illustrated in FIG. 3.

As a result, setting of the print medium M to the printer 100 and maintenance of each portion in the housing 10 can be performed.

Figure 4:
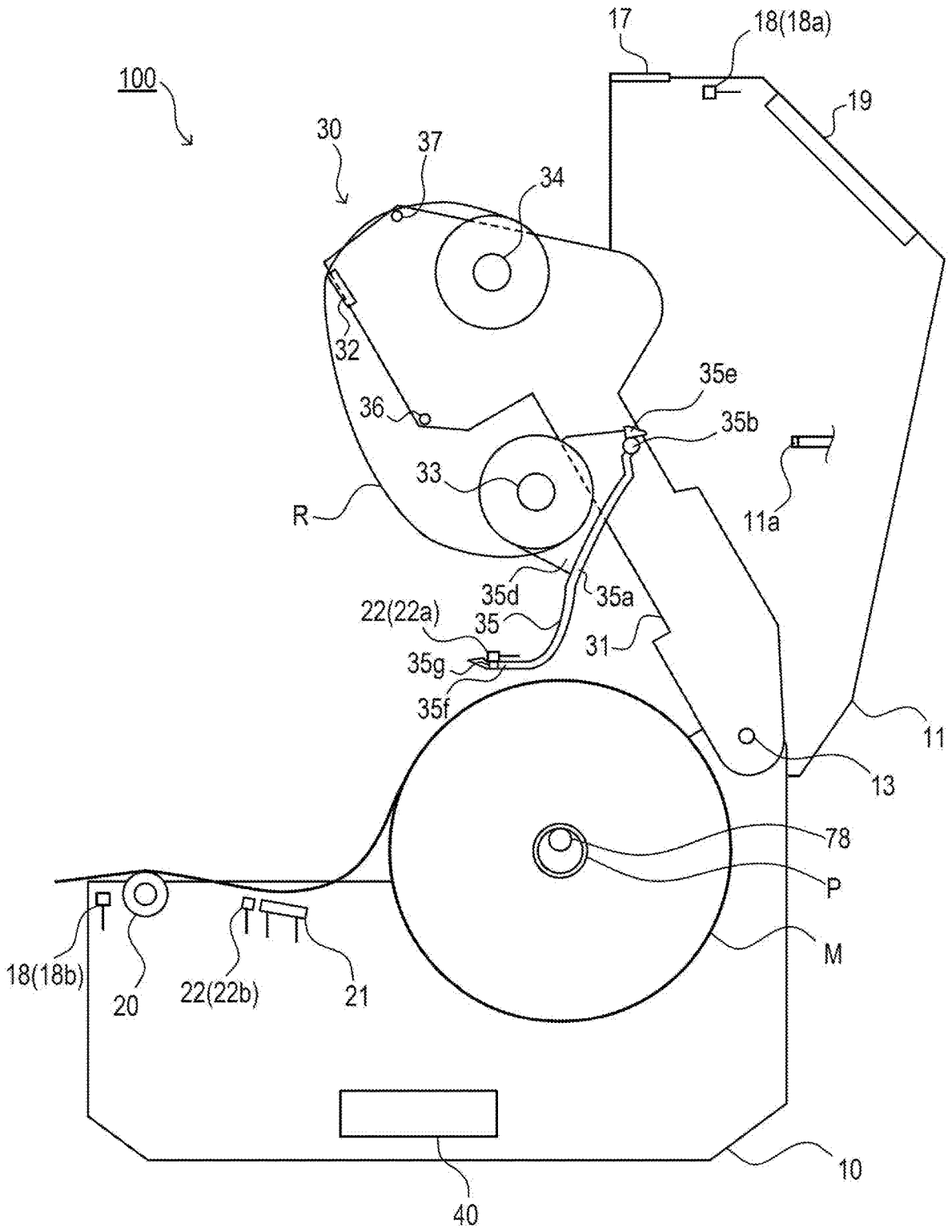
FIG. 4 is a diagram showing a state where a ribbon supply shaft 33 is at a ribbon replacement position.

Moreover, when the engagement between the engaging portion 35*e* and the engaged portion 11*a* is disengaged from the state illustrated in FIG. 3 and the partition member 35 is made to swing toward the housing 10 side, the partition member 35 is brought to the open position illustrated in FIG. 4.

When the partition member 35 is brought to the open position, the ribbon supply shaft 33 and the roll-like ink ribbon R held by the ribbon supply shaft 33 are relatively moved with respect to the ribbon roll-up shaft 34 and are exposed to the discharge port 16 side (FIG. 2) of the print medium M.

As a result, the ribbon supply shaft 33 comes to the ribbon replacement position capable of attachment to/detachment from the printer 100, and a replacing work of the ink ribbon R can be performed.

The engagement between the engaging portion 35*e* and the engaged portion 11*a* is disengaged by causing the partition member 35 to swing to the housing 10 side with a predetermined torque and more, since the engaging portion 35*e* and the engaged portion 11*a* are elastically deformed.

When the engagement between the engaging portion 35*e* and the engaged portion 11*a* is disengaged, the print unit 30 itself swings to a predetermined position toward the housing 10 side. The predetermined position is a position where a swing regulating portion (not shown) provided in the vicinity of the support shaft 13 in the housing 10 and the body portion 31 are brought into contact with each other.

Positioning of the print unit 30 by the swing regulating portion is cancelled by causing the print unit 30 to swing to the housing 10 side with the predetermined torque or more, whereby the swing regulating portion is elastically deformed, and the body portion 31 rides over the swing regulating portion.

Moreover, as illustrated in FIG. 2, a feed guide portion 35*f* is provided on the other end side of the base portion 35*a* in the partition member 35. The feed guide portion 35*f* is faced with a reflection sensor 21 and forms a feed path of the print medium M between that and the reflection sensor 21 when the print unit 30 is at the print position as illustrated in FIG. 2.

The reflection sensor 21 is an optical sensor having a light emitting portion which emits predetermined light and a light receiving portion which receives reflection light of the light emitted from the light emitting portion from the print medium M and outputs an electric signal corresponding to intensity of the received light.

The reflection sensor 21 detects counter marks printed in advance at a predetermined interval on a surface on the side opposite to a surface on which the print is performed of the print medium M.

As a result, the reflection sensor 21 can detect a position of the print medium M in the feeding direction.

Here, if sagging or waving occurs in the print medium M during feeding, a distance between the reflection sensor 21 and the print medium M becomes larger, and there is a concern that detection accuracy of the reflection sensor 21 is lowered.

On the other hand, in this embodiment, when the print unit 30 is at the print position, that is, in the state illustrated in FIG. 2, since the feed guide portion 35*f* of the partition member 35 forms the feed path between that and the reflection sensor 21, the print medium M is guided by the feed guide portion 35*f*, and the print medium M is fed within a certain distance from the reflection sensor 21. Thus, the distance between the reflection sensor 21 and the print medium M can be prevented from getting larger due to sagging or waving of the print medium M, and the detection accuracy of the reflection sensor 21 can be made stable.

Moreover, since the feed path of the print medium M is formed by the feed guide portion 35*f* provided on the partition member 35, a member for allowing the print medium M to be fed within a certain distance from the reflection sensor 21 does not have to be provided separately, and a work of inserting the print medium M in the member is not necessary.

Moreover, since the partition member 35 is provided on the print unit 30, when the print unit 30 is at the non-print position, the entire feed path of the print medium M can be exposed. Thus, even if it is configured that the print medium M is fed within a certain distance from the reflection sensor 21 by providing the feed guide portion 35*f* on the partition member 35, the work of setting the print medium M on the printer 100 can be performed easily.

Moreover, as illustrated in FIG. 2, the printer 100 includes a transmission sensor 22 for detecting a position of the print medium M in the feeding direction.

The transmission sensor 22 is an optical sensor having a light emitting unit 22*a* as a light emitting portion which emits predetermined light and a light receiving unit 22*b* as a light receiving portion which receives the light emitted from the light emitting unit 22*a* and outputting an electric signal corresponding to the intensity of the received light.

If the print medium M is a label continuous body in which a plurality of labels is temporarily attached continuously at a predetermined interval to a band-like liner sheet, for example, a portion only of the liner sheet is present between the two adjacent labels.

Since a transmission amount of the light emitted from the light emitting unit 22*a* is different between a portion on which the label is present and the portion only of the liner sheet, the intensity of the light received by the light receiving unit 22*b* is fluctuated. As a result, the reflection sensor 21 can detect the position of the print medium M in the feeding direction.

In this embodiment, as illustrated in FIG. 2, the light emitting unit 22*a* is provided on the side opposite to the feed path of the print medium M in the feed guide portion 35*f*, that is, on an upper surface side of the feed guide portion 35*f*. Moreover, a through hole 35*g* through which the light emitted from the light emitting unit 22*a* is passed is formed in the feed guide portion 35*f*. On the other hand, the light receiving unit 22*b* is provided on the housing 10 side with the feed path between them as illustrated in FIG. 2.

As described above, the work of setting the print medium M on the printer 100 is performed in the state where the print unit 30 is at the non-print position, and the opening portion of the housing 10 is open.

That is, in this embodiment, since the print medium M can be set on the printer 100 in the state where a space between the light emitting unit 22*a* and the light receiving unit 22*b* is wide open, the work of setting the print medium M on the printer 100 can be performed easily. The positions of the light emitting unit 22*a* and the light receiving unit 22*b* may be switched.

The printer 100 is configured to detect the position of the print medium M in the feeding direction by operating either of the reflection sensor 21 or the transmission sensor 22 in accordance with a mode of the print medium M to be used.

When the print medium M without counter marks provided is used, for example, the printer 100 detects the position of the print medium M by the transmission sensor 22.

The controller 40 is constituted by a microprocessor, a storage device such as a ROM, a RAM and the like, an input/output interface, a bus connecting them and the like.

Into the controller 40, print data from an external computer, signals from the transmission sensors 18 and 22, a signal from the reflection sensor 21 and the like are input through the input/output interface.

The controller 40 executes a print control program stored in the storage device by the microprocessor and controls conduction to the heating element of the thermal head 32, conduction to each of the driving motors and the like.

[Configuration of Roll Guide 60]

Figure 5:
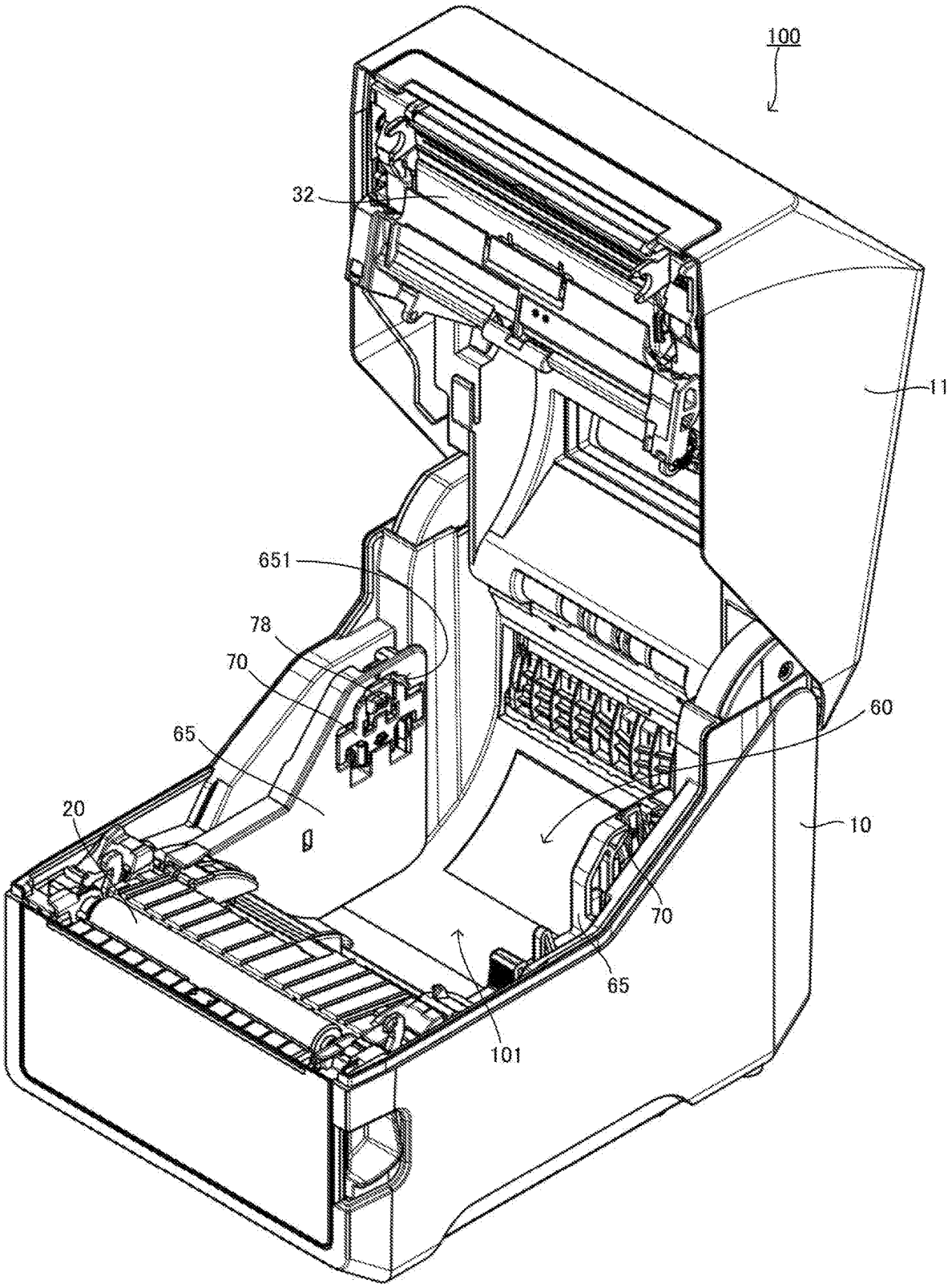
FIG. 5 is a perspective view of an open state of the printer 100 according to the embodiment of the present invention.
Figure 6:
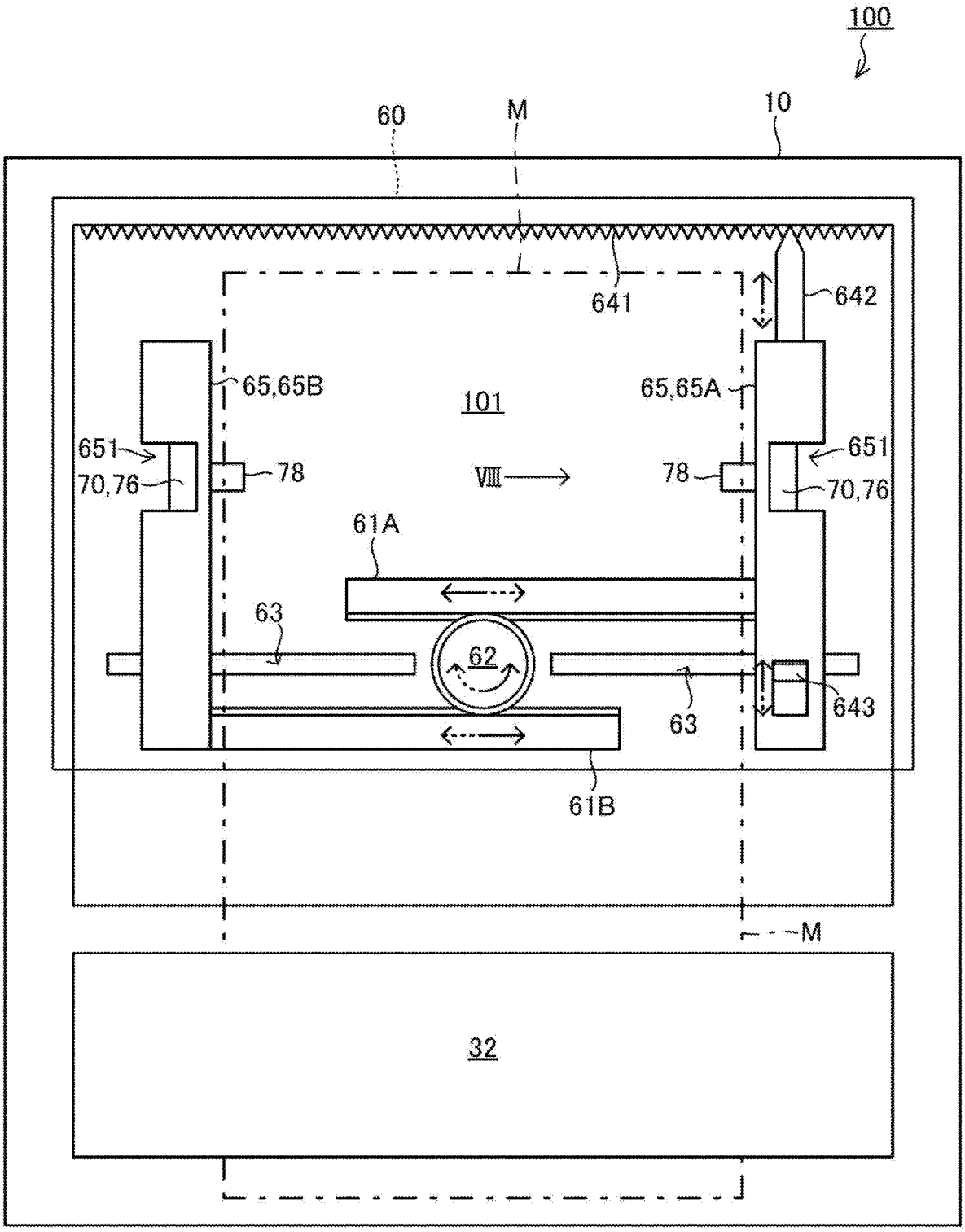
FIG. 6 is a plan view of the printer 100 according to the embodiment of the present invention and a roll guide 60 constituting it.
Figure 7:
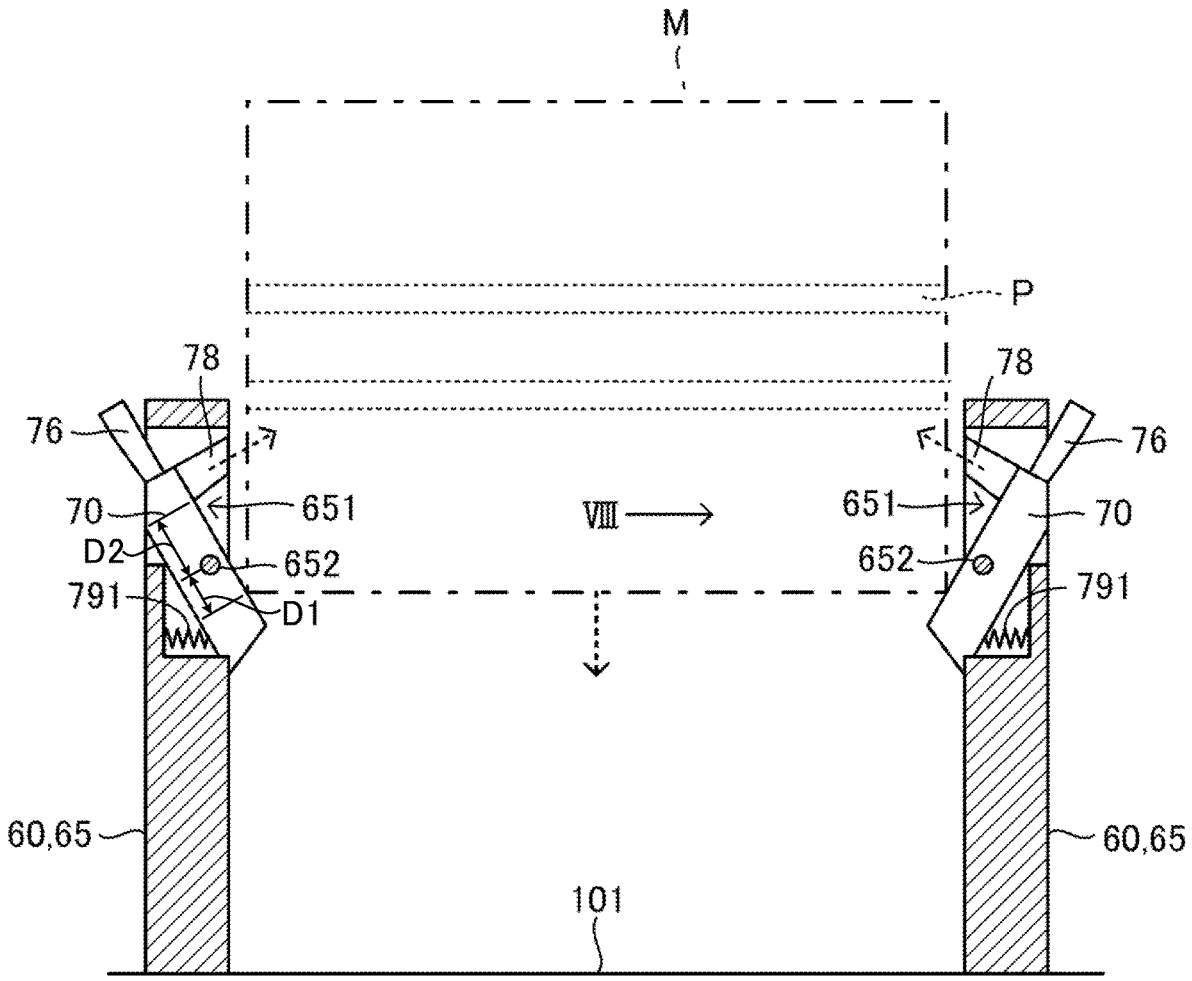
FIG. 7 is a sectional view showing the roll guide 60 constituting the printer 100 according to the embodiment of the present invention.

FIG. 5 is a perspective view of the open state of the printer 100 according to the embodiment of the present invention. FIG. 6 is a plan view of the printer 100 according to the embodiment of the present invention and a roll guide 60 constituting it. FIG. 7 is a sectional view illustrating the roll guide 60 constituting the printer 100 according to the embodiment of the present invention.

As illustrated in FIG. 5, the roll guide 60 is disposed in a roll accommodating recess portion 101 formed in the housing 10 and opened upward.

The roll guide 60 includes a pair of support members 65 (65A, 65B) into which the print medium M is inserted from above to a bottom part direction (insertion direction) along its diameter direction (FIG. 7).

The support members 65 (65A, 65B) are disposed on the bottom part of the roll accommodating recess portion 101 in a direction (hereinafter, width direction) orthogonal to a feeding-out direction (substantially horizontal direction) of the print medium M at an interval.

As illustrated in FIG. 6, the support members 65A and 65B are slidable in the width direction along guide grooves 63 disposed so as to extend in the width direction in the roll accommodating recess portion 101, respectively.

Racks 61A and 61B extending in the width direction, respectively, are mounted on the support members 65A and 65B, respectively, and the rack 61A and the rack 61B are disposed with a shift from each other substantially in the horizontal direction.

A pinion 62 is sandwiched between the rack 61A and the rack 61B, and the rack 61A and the rack 61B are mechanically connected through the pinion 62.

The pair of support members 65A and 65B are slidable in the width direction in a direction where they are separated from each other or in a direction where they get closer to each other by rotating the pinion 62, and sliding amounts are the same as each other.

A locking mechanism for locking this support member 65A at an arbitrary position along the aforementioned guide groove 63 is provided in the support member 65A.

This locking mechanism is constituted by a large number of serrated state locking grooves 641 formed at a position on an inner wall surface of the roll accommodating recess portion 101, faced with a side surface of the support member 65, in parallel with the guide groove 63 and a stopper 642 attached to a portion faced with the locking grooves 641 of the support member 65A and engaged with/disengaged from the locking groove 641 by operating an operation portion 643 in the feeding-out direction of the print medium M.

By engaging the stopper 642 with the locking groove 641, sliding of the support member 65A and the rack 61A is prohibited, and since rotation of the pinion 62 is prohibited by the rack 61A, sliding of the rack 61B and the support member 65B is also prohibited.

Moreover, by withdrawing the stopper 642 from the locking groove 641, sliding of the support member 65A and the rack 61A is allowed, whereby rotation of the pinion 62 is also allowed, and the sliding of the rack 61B and the support member 65B is also allowed.

As illustrated in FIGS. 6 and 7, the roll guide 60 has the pair of support members 65, the swing member 70 including the holding pin 78 for rotatably holding the print medium M and mounted on the support member 65, capable of swing and the like.

In the support member 65, a swing shaft 652 (see FIG. 7) extending in the width direction and in a direction (substantially horizontal direction) substantially orthogonal to a vertical direction (taking-in/out direction of the print medium M) of the printer 100 is provided.

The swing member 70 is mounted on the support member 65 through the swing shaft 652, capable of swing. The swing member 70 is mounted on the support member 65 so that its major surface (front surface) is faced with a holding region (a region where the print medium M is loaded/held in the roll accommodating recess portion 101).

The swing member 70 is a plate-shaped member having an outer shape in a direction (hereinafter, referred to as a swing shaft direction) in parallel with the swing shaft 652 and a direction (hereinafter, referred to as a swing radial direction) perpendicular to that, is connected to the swing shaft 652 at a center part in the swing radial direction and swings like a see-saw around the swing shaft 652 (swing shaft direction).

Here, the swing radial direction is the direction perpendicular to the swing shaft direction and is a direction along a shaft rotating around the swing shaft 652 and can be in parallel with the vertical direction (taking-in/out direction of the print medium M) or cross (inclined) to the vertical direction by rotating around the swing shaft 652.

The holding pin 78 is disposed at a position on an upper side (on the taking-out direction side of the print medium M) than the swing shaft 652 of the swing member 70.

Moreover, a first biasing spring 791 (first biasing means) is mounted at a position on a lower side (an insertion direction side of the print medium M) than the swing shaft 652 of the swing member 70.

The first biasing spring 791 biases a portion on the lower side than the swing shaft 652 of the swing member 70 to a direction pushing out to the holding region (roll accommodating recess portion 101) side of the print medium M.

As a result, the pair of swing members 70 is brought into a state (initial state) where the pair of holding pins 78 swings in the direction where they are separated from each other by the first biasing spring 791.

Here, the holding pin 78 is designed so that the holding pin 78 does not protrude from the surface (surface faced with the holding region) of the support member 65 in the initial state (see FIG. 7). In the FIG. 7 embodiment, each swing member 70 has an initial contact point of the print medium M spaced from the swing-member axis at swing shaft 652 by a first distance D1 and each holding pin 78 is spaced from the swing-member axis at shaft 652 by a second distance D2, the first distance being smaller than the second distance.

On the other hand, when the swing member 70 is made to swing in a direction of compressing the first biasing spring 791, the surface (surface on the holding region side) of the swing member 70 is brought into a state where the holding pin 78 protrudes from the surface of the support member 65 to the holding region side (see FIG. 6, a second swing state which will be described later).

As will be described later, in this embodiment, when the holding pin 78 protrudes to the holding region side, considering a case where its distal end is brought into contact with an end surface of the print medium M, a constitution that the holding pin 78 is retreated in the direction not protruding from the surface of the swing member 70 so as to avoid interference with the swing of the swing member 70 is included (a first swing state which will be described later, see FIGS. 16 and 17).

Moreover, in this constitution, when the holding pin 78 is faced with an inside of the tubular material P of the print medium M, an operation that it protrudes from the swing member 70 and enters into the tubular material P is made possible (see the second swing state which will be described later and FIGS. 18 and 19).

Figure 8:
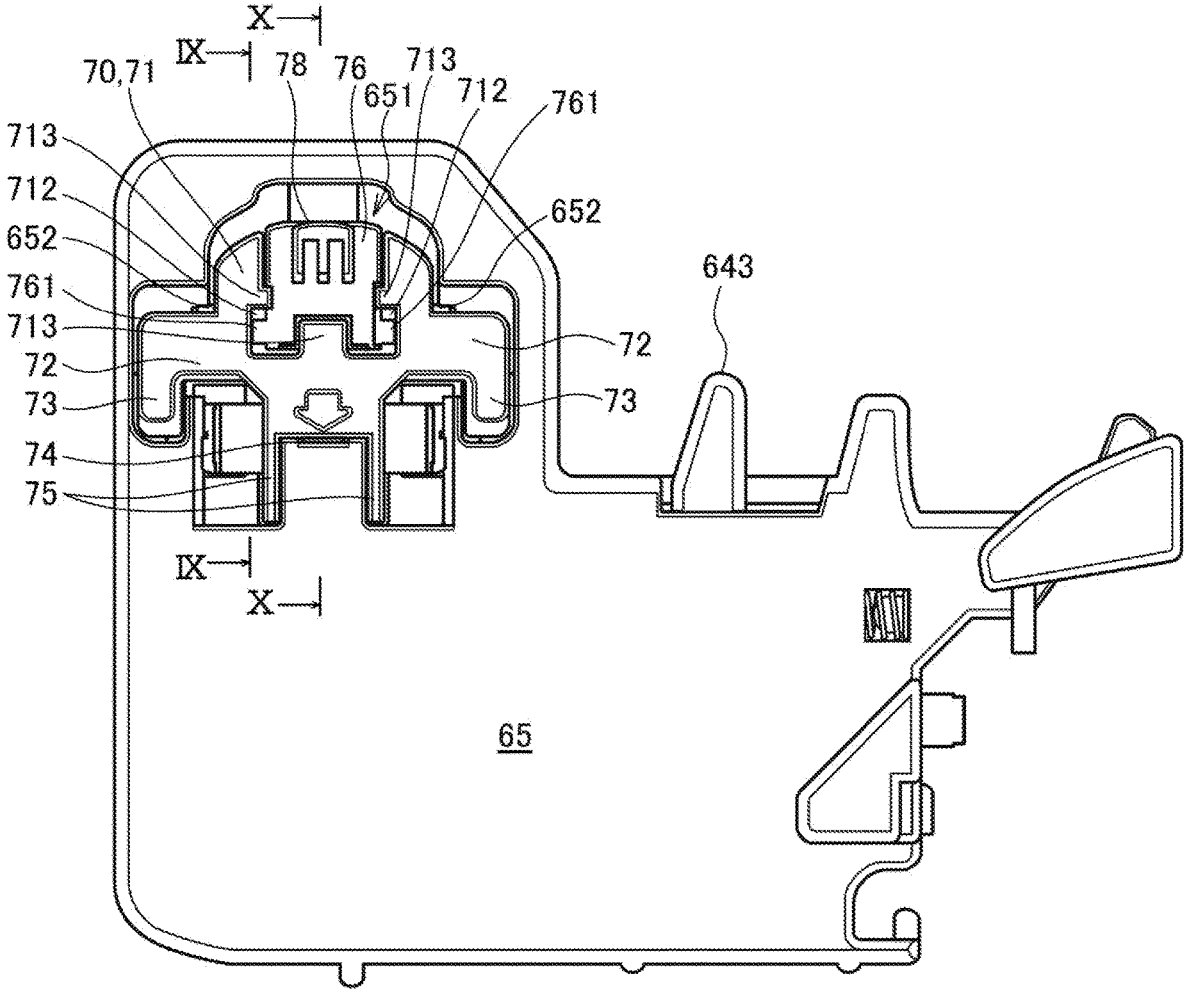
FIG. 8 is a VIII arrow view of FIGS. 6 and 7 and a schematic configuration diagram of a support member 65 constituting the roll guide 60 and a swing member 70.
Figure 9:
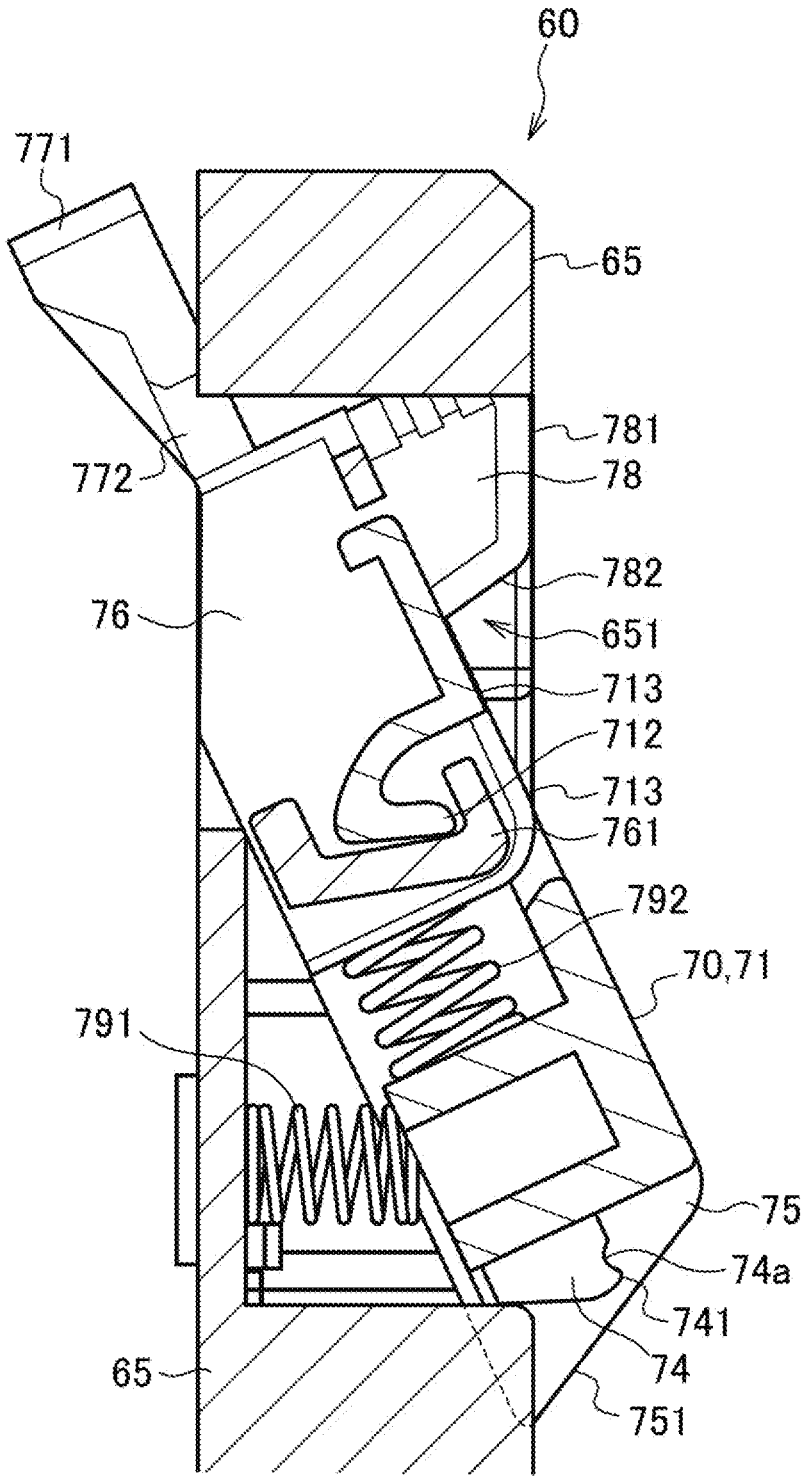
FIG. 9 is a IX-IX line sectional view of FIG. 8.
Figure 10:
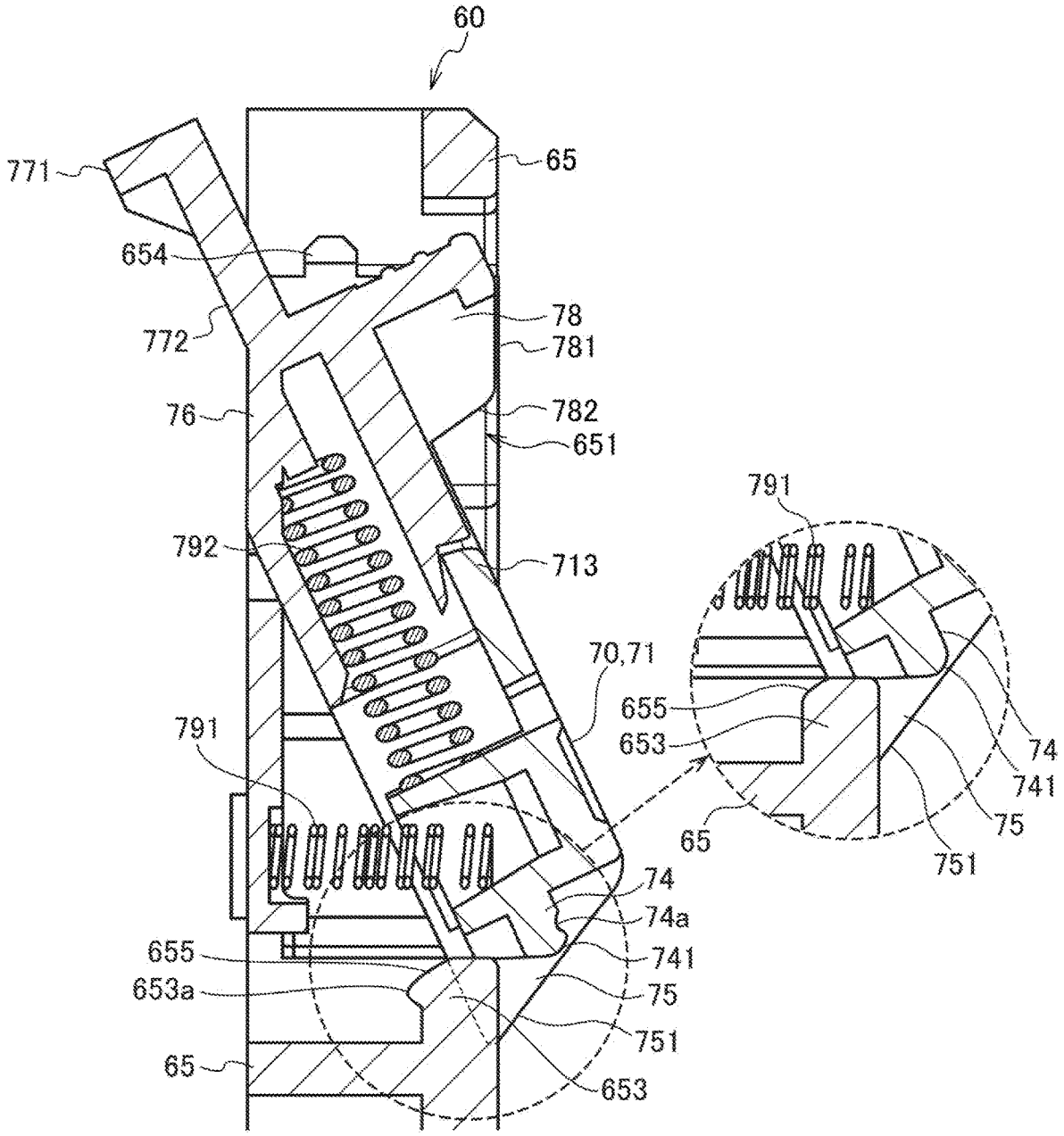
FIG. 10 is a X-X line sectional view of FIG. 8.

FIG. 8 is a VIII arrow view of FIGS. 6 and 7 and a schematic configuration diagram of the support member 65 constituting the roll guide 60 and the swing member 70. FIG. 9 is a IX-IX line sectional view of FIG. 8. FIG. 10 is a X-X line sectional view of FIG. 8.

Figure 11:
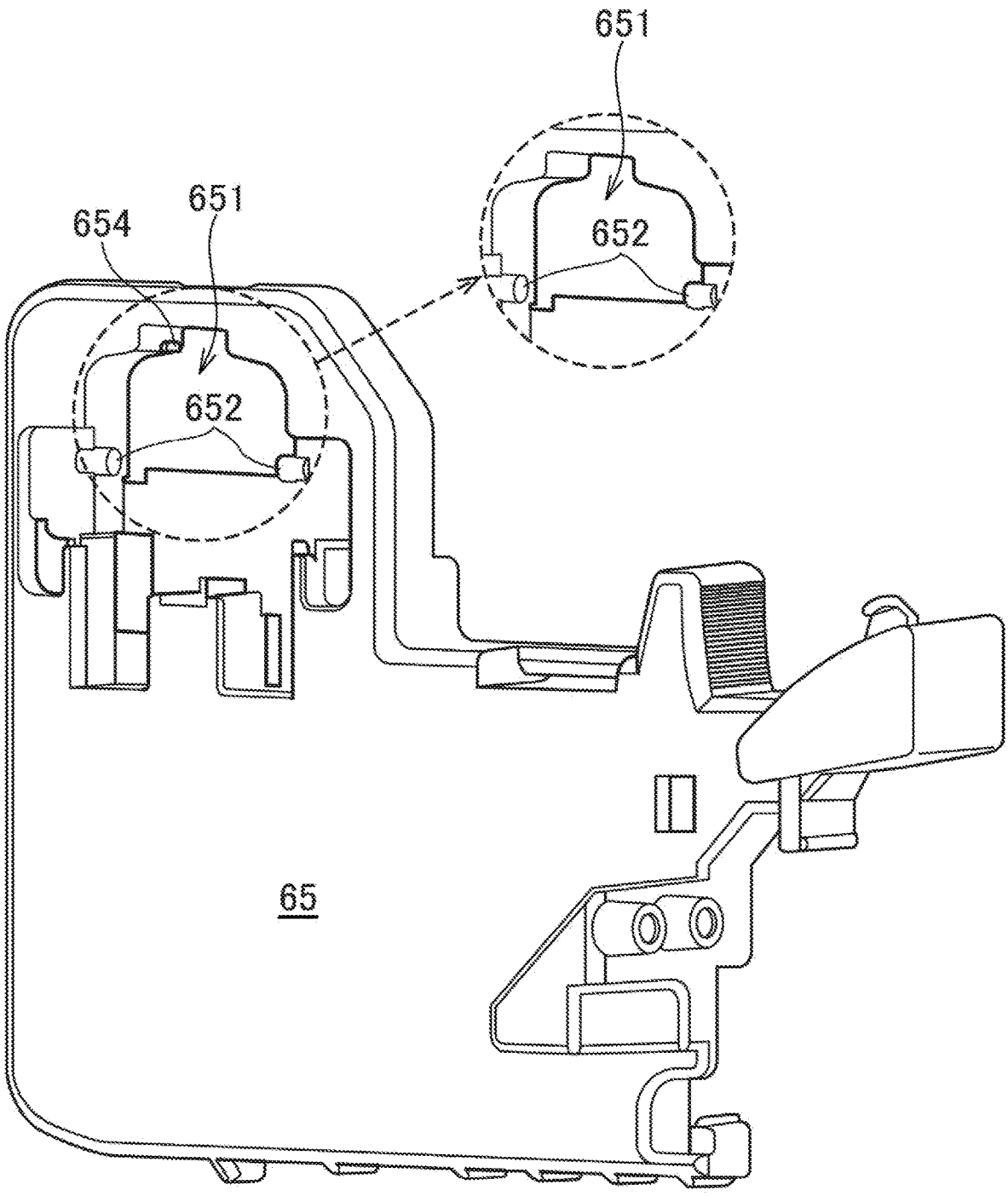
FIG. 11 is a perspective view of the support member 65 constituting the roll guide 60.
Figure 12:
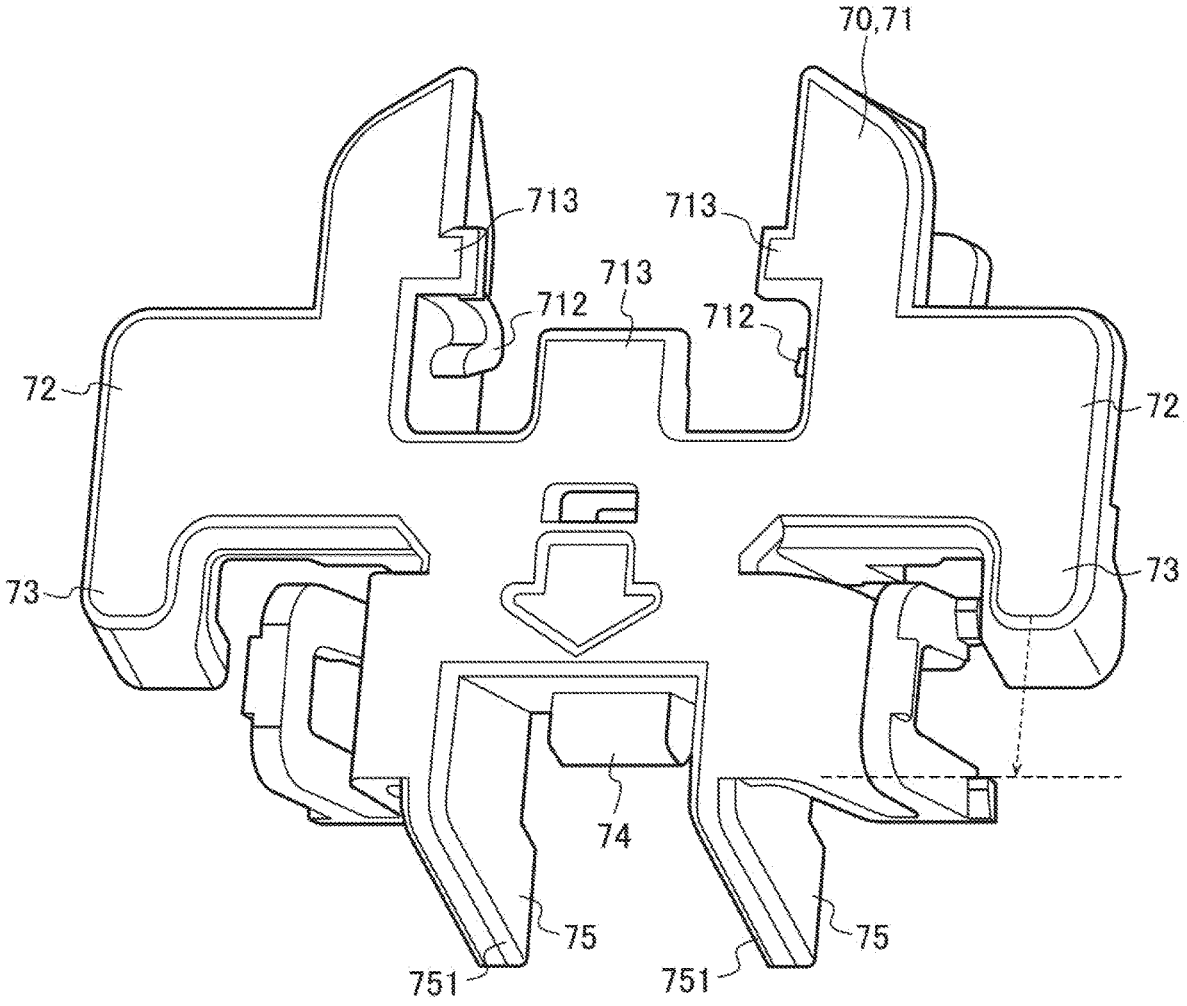
FIG. 12 is a perspective view of the swing member 70 (arm portion 71) constituting the roll guide 60.
Figure 13:
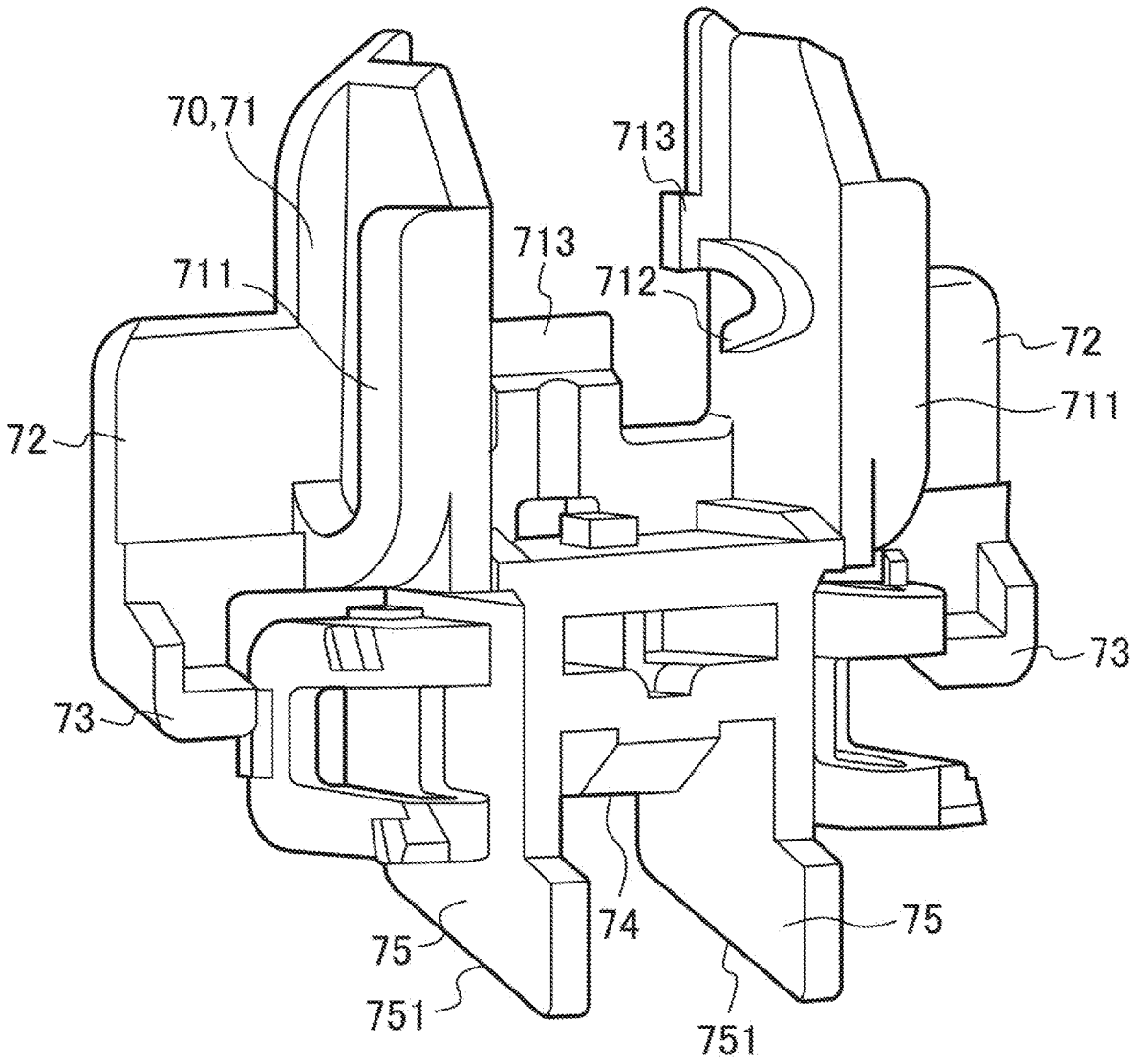
FIG. 13 is a rear view of FIG. 12.
Figure 14:
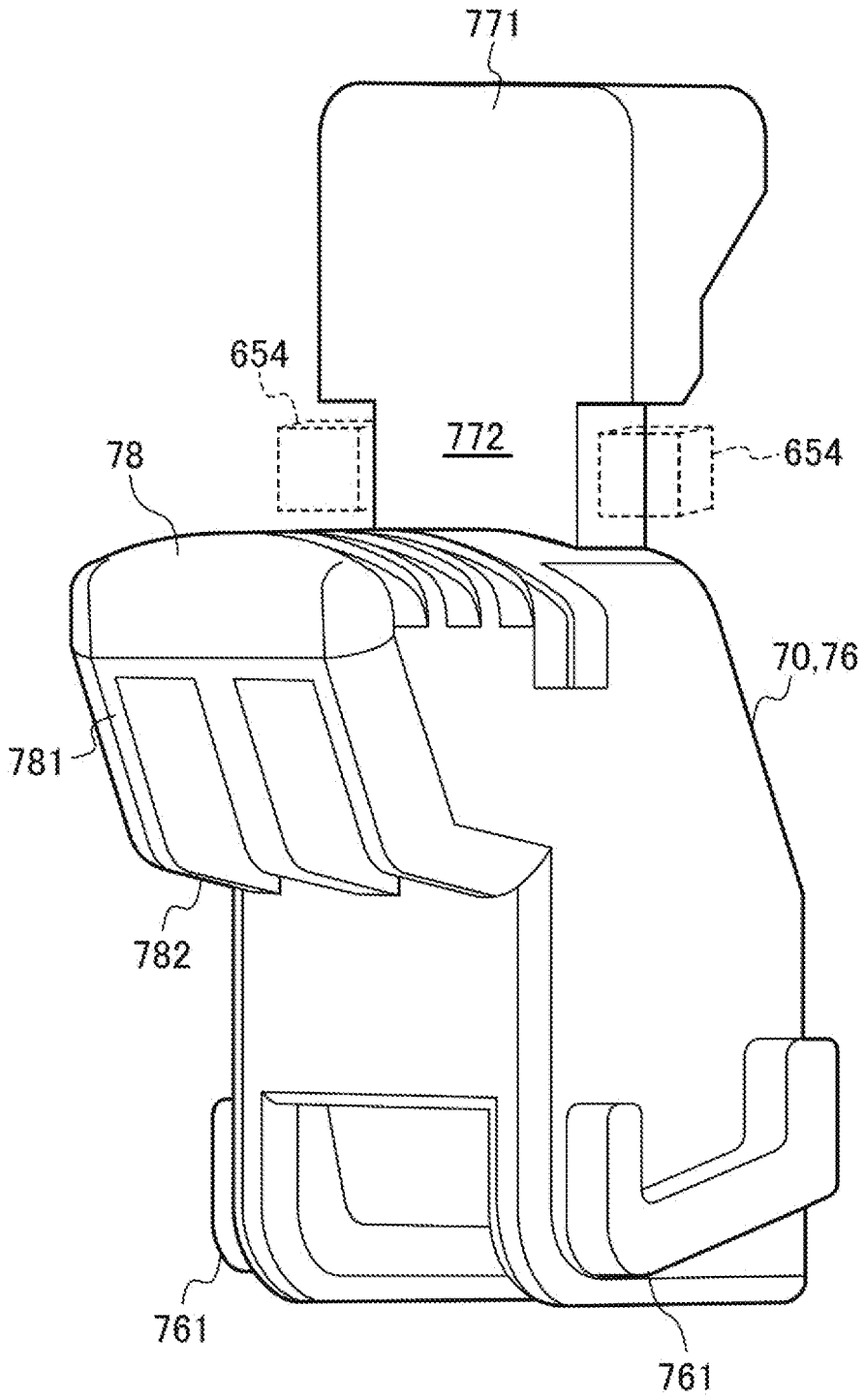
FIG. 14 is a perspective view of the swing member 70 (retreating operation portion 76) constituting the roll guide 60.

FIG. 11 is a perspective view of the support member 65 constituting the roll guide 60. FIG. 12 is a perspective view of the swing member 70 (arm portion 71) constituting the roll guide 60. FIG. 13 is a rear view of FIG. 12. FIG. 14 is a perspective view of the swing member 70 (retreating operation portion 76) constituting the roll guide 60.

As illustrated in FIG. 8, the swing member 70 is disposed so as to be biased to an upper part of the support member 65 (a portion on the taking-out direction side of the print medium M in the support member 65).

The swing member 70 is designed to have dimensions such that a length in the swing radial direction (substantially vertical direction in FIG. 8) thereof is smaller than the length of the support member 65 in a height direction.

Moreover, the swing member 70 is designed to have dimensions such that the length in the swing shaft direction is larger than the length of the swing radial direction of the swing member 70.

An accommodating portion 651 having a shape following an outer shape of the swing member 70 and capable of accommodating the swing member 70 in the support member 65 is formed on an upper part of the support member 65. Moreover, the swing shaft 652 (see FIG. 11) is provided on both side surfaces in the accommodating portion 651.

As illustrated in FIG. 8 (for details, see FIGS. 12 and 13), the swing member 70 has the arm portion 71 (swing member body) supported capable of swing through the swing shaft 652 with respect to the support member 65 and supporting the retreating operation portion 76 (FIG. 14) which will be described later so as to sandwich it, a first extension portion 72 extending from right and left side surfaces of the arm portion 71 to the substantially swing shaft direction, a second extension portion 73 extending from a distal end of the first extension portion 72 to the swing radial direction (substantially downward), and a fitting portion 74 and a shielding portion 75 extending substantially downward from a lower part of the arm portion 71, and they are formed integrally.

The arm portion 71, the first extension portion 72, the second extension portion 73, and the shielding portion 75 form the same plane on the surface of each of them on the holding region side.

The arm portion 71 has its major surface (front surface) faced with the holding region side and is faced or in contact with the print medium M. Moreover, on the rear surface thereof, a bearing portion 711 (see FIG. 13) connected to the swing shaft 652, capable of swing, and capable of causing the entire arm portion 71 to slide substantially in the vertical direction with respect to the swing shaft 652 is mounted.

The bearing portion 711 has a groove shape extending in the swing radial direction and including an opening portion into which the swing shaft 652 is introduced on an upper end thereof (an end portion on the positive swing radial direction side) and can cause the entire arm portion 71 to slide in the swing radial direction (substantially vertical direction) by causing the swing shaft 652 to slide in the groove.

As illustrated in FIGS. 9 and 10, the first biasing spring 791 has, with a substantially width direction as a longitudinal direction, one end in the longitudinal direction mounted on the support member 65 (accommodating portion 651) and the other end mounted (or in contact with) at a position on the lower side than the bearing portion 711 of the arm portion 71.

The arm portion 71 has two arms, and the retreating operation portion 76 is disposed between these two arms (see FIG. 8). The retreating operation portion 76 is a member having the swing radial direction of the swing member 70 as the longitudinal direction in the initial state.

As illustrated in FIG. 9, a swing fulcrum 712 is disposed on the surface faced with the retreating operation portion 76 of the arm, having a shape bent downward while extending toward the rear side of the swing member 70 and going toward the front side of the arm portion 71 and having a distal end at a position close to the front side of the arm portion 71.

A U-shaped fulcrum receiving portion 761 is disposed at a position corresponding to the swing fulcrum 712 on a lower part of the retreating operation portion 76.

The swing fulcrum 712 and the fulcrum receiving portion 761 are engaged with each other in a mode in which the distal end (lower end) of the swing fulcrum 712 enters into the receiving portion 761 and is in contact with a bottom surface thereof.

Figure 16:
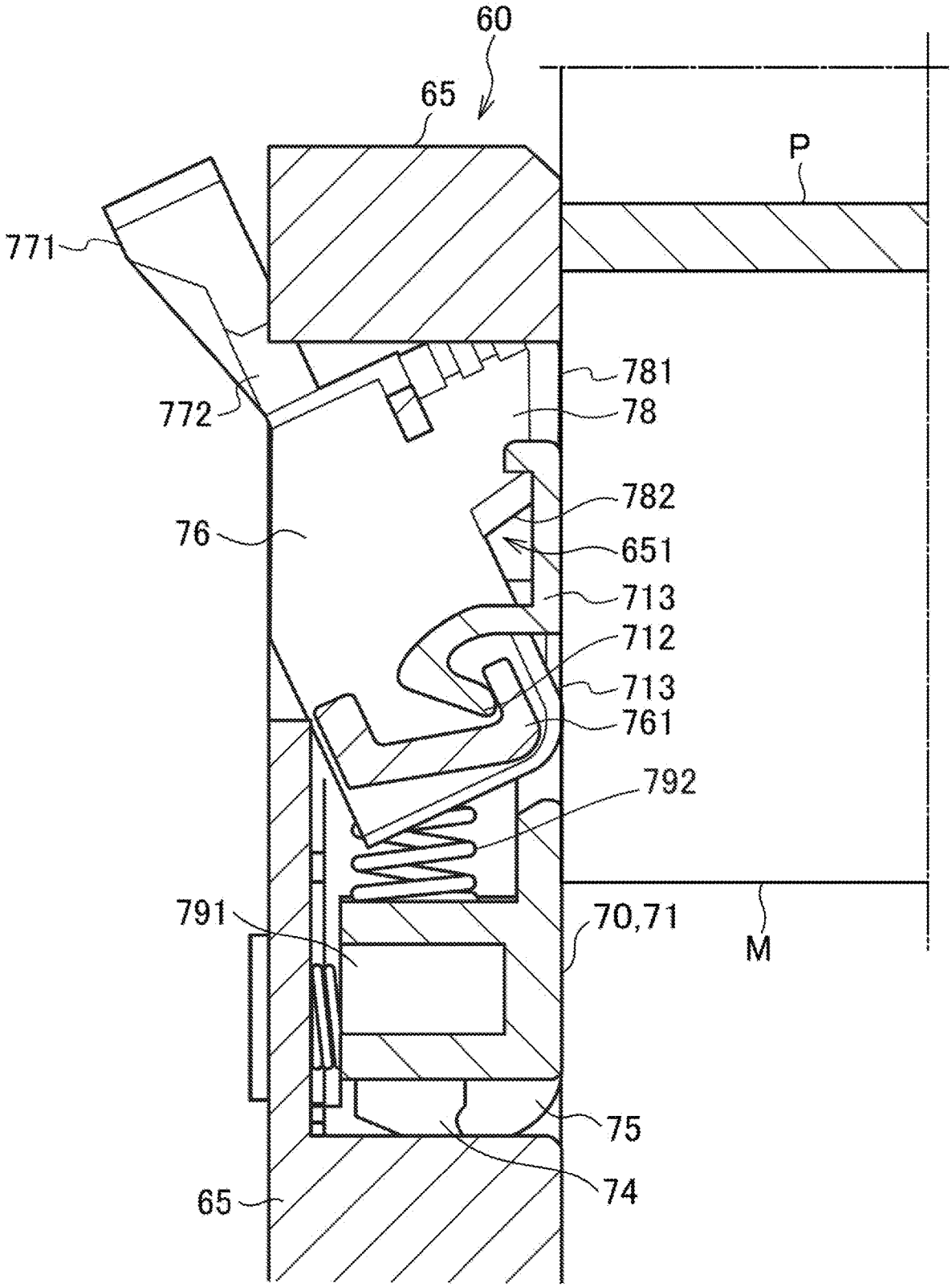
FIG. 16 is a view for explaining an operation of loading/holding of a print medium M in the roll guide 60 (after swing of the arm portion 71) and corresponds to FIG. 9.

The retreating operation portion 76 can swing (rotationally move) with respect to the arm portion 71 with the direction substantially in parallel with the swing shaft 652 as an axis around the distal end of the swing fulcrum 712 (see FIG. 16).

As illustrated in FIGS. 9 and 10, a second biasing spring 792 (second biasing means) is mounted between the arm portion 71 and the retreating operation portion 76 in the swing radial direction.

The second biasing spring 792 has the swing radial direction as the longitudinal direction in the initial state and has one end in the longitudinal direction in contact with the arm portion 71 and the other end in contact with the retreating operation portion 76.

The second biasing spring 792 is disposed at a position displaced by a predetermined distance from the distal end of the swing fulcrum 712 toward the rear side of the swing member 70.

A compression stress is given (applied) to the second biasing spring 792 by the arm portion 71 and the retreating operation portion 76.

By means of the aforementioned disposition, the second biasing spring 792 gives the biasing force causing the retreating operation portion 76 to relatively swing to the holding region side with respect to the arm portion 71 around the contact position of the fulcrum receiving portion 761 with the swing fulcrum 712.

The arm portion 71 includes the stopper 713 brought into contact with the retreating operation portion 76 when the retreating operation portion 76 reaches the predetermined swing position.

The stopper 713 is designed to be brought into contact with the retreating operation portion 76 at a position where the surface of the retreating operation portion 76 (excluding the holding pin 78) forms substantially the same plane as the surface of the arm portion 71, and at this time, the holding pin 78 is disposed in a state protruding from the surface of the arm portion 71.

In this embodiment, the stopper 713 is disposed at three spots (see FIG. 12).

By means of the aforementioned configuration, the retreating operation portion 76 swings around the swing shaft 652 basically integrally with the arm portion 71.

However, when the distal end of the holding pin 78 provided on the retreating operation portion 76 is brought into contact with the end surface of the print medium M as will be described later, the retreating operation portion 76 relatively swings in the direction where the holding pin 78 does not protrude from the arm portion 71 around the distal end of the swing fulcrum 712 by using the reaction force when being brought into contact with the print medium M (see FIGS. 16 and 17).

The first extension portion 72 (see FIGS. 8, 12, and 13) is a portion extending in the both directions in the swing shaft direction from the arm portion 71.

At the distal end of the first extension portion 72, the second extension portion 73 extending to the lower side (side protruding to the holding region side by the first biasing spring 791) of the swing member 70 is provided.

Figure 22:
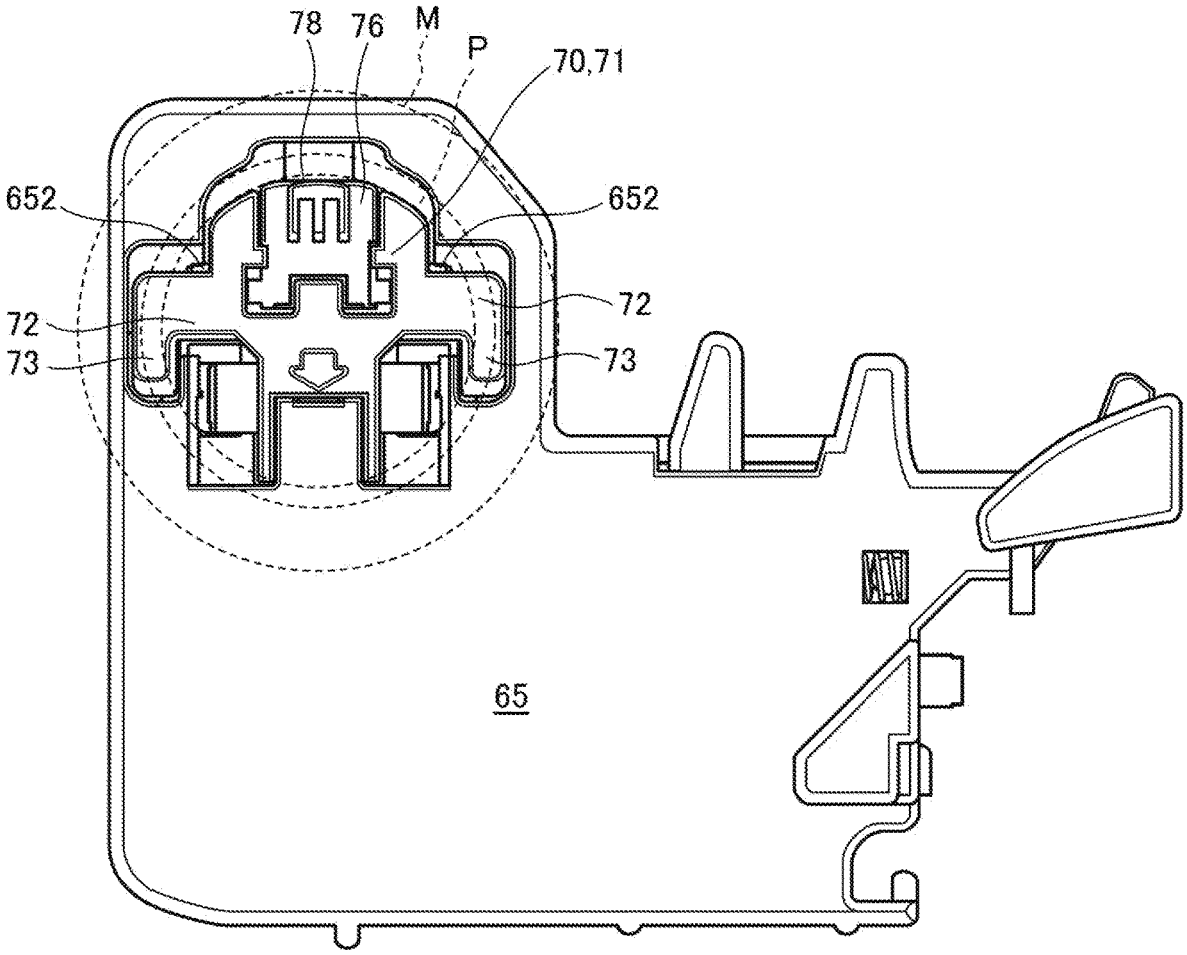
FIG. 22 is a view illustrating a relationship among a first extension portion 72, the second extension portion 73, and the print medium M constituting the swing member 70.

FIG. 22 is a diagram illustrating a relationship between the first extension portion 72 and the second extension portion 73 constituting the swing member 70 and the print medium M.

As illustrated in FIG. 22 and the like, a length of the line connecting the distal ends of the two first extension portions 72, that is, the length of the swing member 70 in the swing shaft direction is suitably designed longer than the length of the swing member 70 (arm portion 71) in the swing radial direction.

The second extension portion 73 is disposed at a position where its distal end comes below an extension of the swing shaft 652 (a position separated in the negative swing radial direction side and a position swinging into contact with the print medium M by the second biasing spring 792) when the swing member 70 is in contact with the loaded print medium M.

As a result, even if the inner diameter of the tubular material P of the print medium M is longer than the length of the arm portion 71 in the swing radial direction and the entire arm portion 71 is disposed inside the tubular material P when seen from the width direction, the end portion of the first extension portion 72 in the swing shaft direction and the second extension portion 73 are brought into contact with the print medium M.

Moreover, since the second extension portion 73 is in contact with the print medium M in a state disposed at a position separated from the extension of the swing shaft 652, a constant moment can be received as a drag from the print medium M.

As a result, the arm portion 71 idles by the first biasing spring 791, that is, returning of the swing member 70 to the initial state can be prohibited, and the state where the holding pin 78 enters into the tubular material P can be maintained.

In this embodiment, the swing member 70 has the shape in which the first extension portion 72 and the second extension portion 73 extend from the arm portion 71 but it may have a substantially rectangular shape including outer diameters of the arm portion 71, the first extension portion 72, and the second extension portion 73.

However, by having the shape of this embodiment, the weight of the swing member 70 can be reduced more than a case of the aforementioned substantially rectangular shape and thus, swing of the swing member 70 by the first biasing spring 791 when the print medium M is removed becomes easily, whereby the size of the first biasing spring 791 can be made smaller for that portion.

As illustrated in FIGS. 9 and 10, the lower part of the holding pin 78 is an inclined surface 781 in which a thickness of the holding pin 78 in the swing radial direction becomes larger as it goes to the root of the holding pin 78.

In the initial state (see FIG. 7), the holding pin 78 is designed such that the inclined surface 781 of the holding pin 78 and the front surface (surface on the holding region side) of the support member 65 become substantially the same plane, and the holding pin 78 does not protrude from the surface of the support member 65.

An inclined surface 782 with an inclination angle smaller than that of the inclined surface 781 is formed in the vicinity of the root on the holding pin 78.

Figure 18:
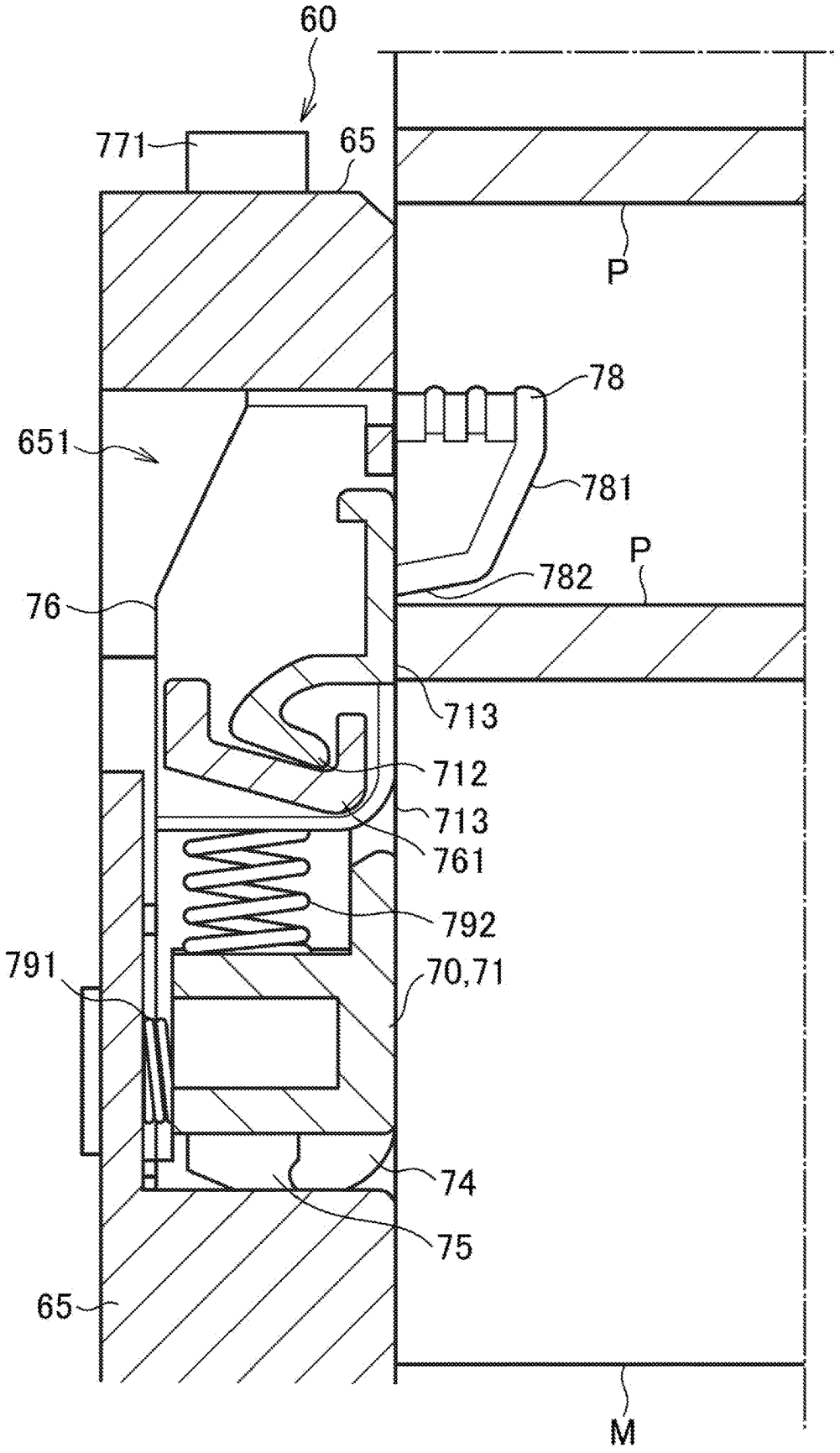
FIG. 18 is a view for explaining the operation of loading/holding of the print medium M in the roll guide 60 (after swing of the retreating operation portion 76) and corresponds to FIG. 9.
Figure 19:
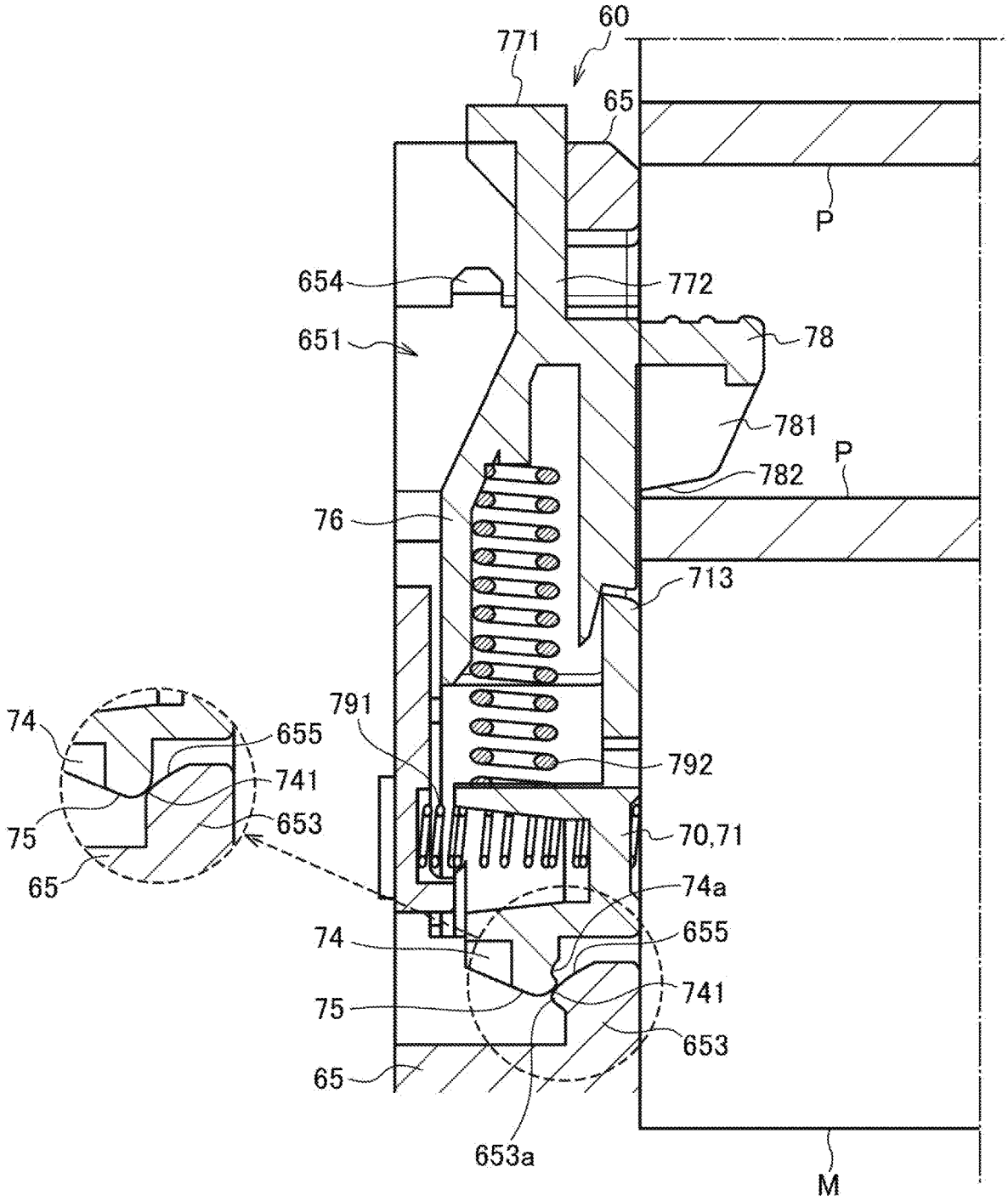
FIG. 19 is a view for explaining the operation of loading/holding of the print medium M in the roll guide 60 (after swing of the retreating operation portion 76) and corresponds to FIG. 10.

The inclined surface 782 is inclined so as to get closer to the tubular material P of the print medium M as it goes toward the root of the holding pin 78 in the state where the holding pin 78 holds the print medium M (see FIGS. 18 and 19).

By means of the aforementioned configuration, the holding pin 78 can be prevented from being caught by the tubular material P of the print medium M when the print medium M is taken out, and the taking-out of the print medium M can be performed easily by causing the holding pin 78 (swing member 70) to swing easily.

Figure 21:
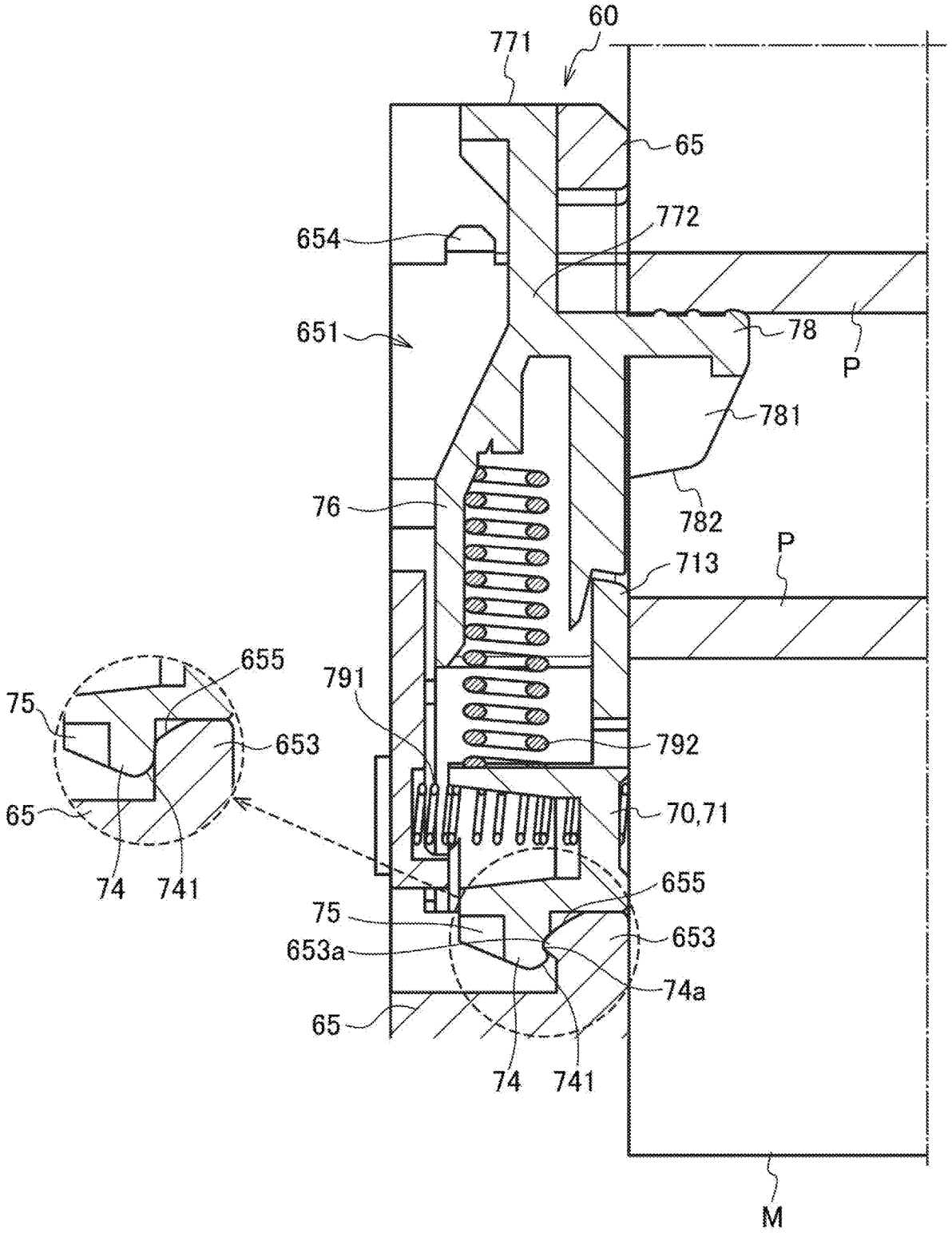
FIG. 21 is a view for explaining the operation of loading/holding of the print medium M in the roll guide 60 (after lock) and corresponds to FIG. 10.

As illustrated in FIG. 10, the fitting portion 74 is a portion formed having a thickness smaller than the thickness of the arm portion 71 and protruding from the lower surface of the arm portion 71 and prohibits swing of the arm portion 71 by being fitted in a fitted portion 653 formed on a lower part of the accommodating portion 651 (see FIG. 21).

Here, on the surface of the fitting portion 74 faced with the fitted portion 653, a recess portion **74*a* is formed, for example, and on the surface of the fitted portion 653 faced with the fitting portion 74, a projecting portion 653*a* is formed, for example, and when the recess portion 74*a* is fitted with the projecting portion 653*a*, the fitting portion 74 is fitted with the fitted portion 653. As will be described later, as illustrated in a broken circle in FIG. 10 and the like, the recess portion 74*a* and the projecting portion 653*a*** can be omitted.

As illustrated in FIG. 10, the fitting portion 74 protrudes from the surface of the support member 65 in the initial stage of the swing member 70 in some cases.

At this time, when the print medium M is taken out of the roll guide 60, a part of the print medium M (roll) is deflected and suspended print medium M (sheet) is brought into contact with the fitting portion 74 in some cases.

At that time, the print medium M (sheet) causes the fitting portion 74 to swing in the direction to further protrude to the holding region side, and not only that taking-out of the print medium M becomes cumbersome but there is a concern that the print medium M (sheet) is broken if the print medium M is forcedly taken out.

Thus, the shielding portion 75 (FIGS. 9 and 10) is provided adjacent to the fitting portion 74 on the arm portion 71.

Figure 15:
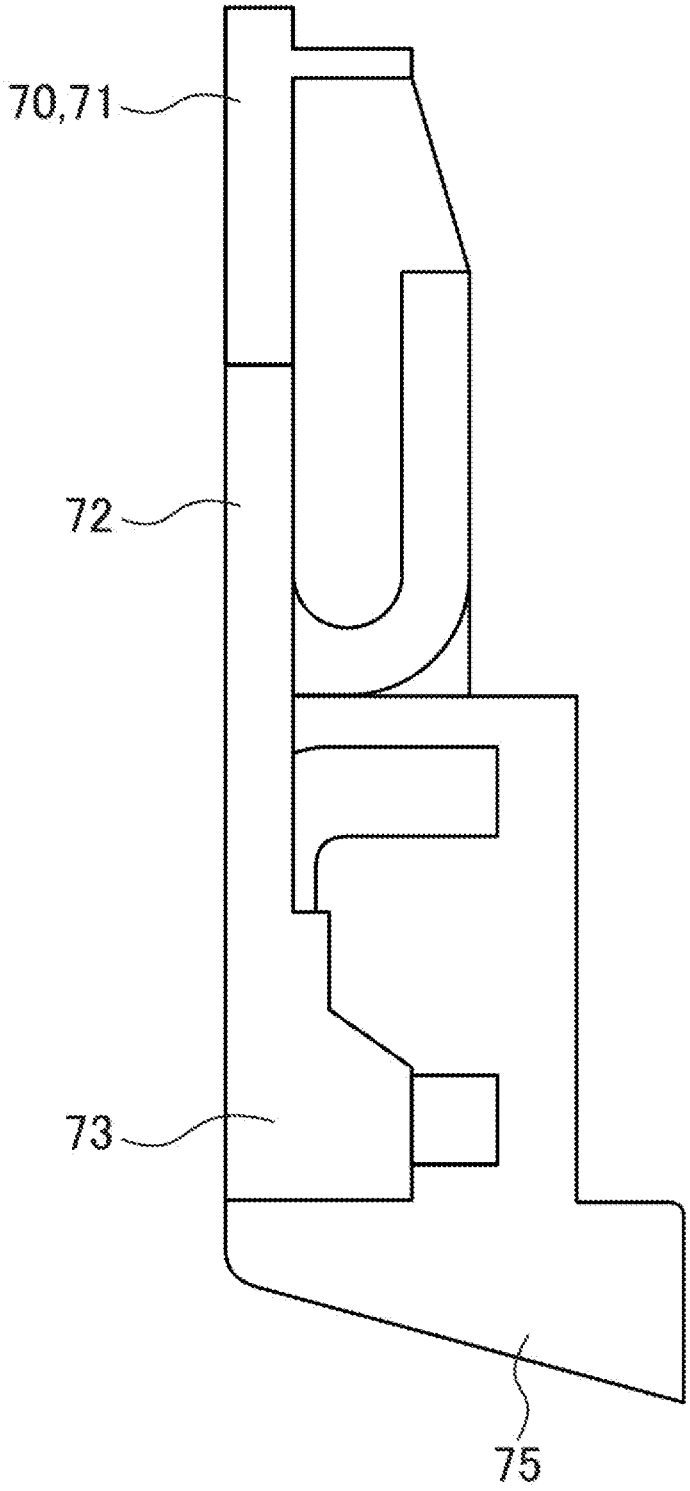
FIG. 15 is a view corresponding to a right side view of FIG. 12 and a left side view of FIG. 13 and a view when a second extension portion 73 is extended longer than a form illustrated in FIGS. 12 and 13.

The shielding portions 75 are formed in pair so as to sandwich the fitting portion 74 (see FIGS. 12 and 13) and the outer shape thereof is formed so that the outer shape of the fitting portion 74 is disposed inside when seen from the swing shaft direction (see FIGS. 9, 10, and 15).

The shielding portion 75 (swing member 70) has a portion protruding to the holding region from the support member 65 when the swing member 70 is in the initial state, and the portion includes the inclined surface 751 forming an outer shape protruding to the holding region side from the support member 65 as it goes toward the taking-out direction of the print medium M.

As a result, when the print medium M is to be taken out of the roll guide 60, even if the fitting portion 74 (swing member 70) protrudes from the surface of the support member 65, a part of the print medium M (roll) is deflected and the suspended print medium M (sheet) is deflected in the width direction and slides on the inclined surface 751 and escapes without being caught by the fitting portion 74.

Therefore, the print medium M (sheet) can be prevented from being caught when the print medium M is taken out.

As illustrated in FIGS. 9 and 10, an outer shape (broken line portions in FIGS. 9 and 10) of the end portion in the insertion direction of the print medium M of the inc1linced surface 751 forming a part of the outer shape of the shielding portion 75 (swing member 70) when seen from the swing shaft direction is disposed inside the outer shape of the support member 65 regardless of the state of the swing member 70. That is, it is designed not to protrude from the surface of the support member 65 even in the initial state.

As a result, such a situation that a part of the print medium M (roll) is deflected and the suspended print medium M (sheet) is brought into contact with the lower end of the inclined surface 751 and causes the shielding portion 75 (swing member 70) to swing in the direction to protrude to the holding region side can be prevented similarly to the above, the print medium M (sheet) can be prevented from being caught when the print medium M is taken out.

FIG. 15 is a view corresponding to the right side view of FIG. 12 and the left side view of FIG. 13 and is a view when the second extension portion 73 is extended more than the form illustrated in FIGS. 12 and 13. As illustrated in FIG. 15, the aforementioned second extension portion 73 can be extended to a range (a position indicated by a broken arrow in FIG. 12, for example) in which the outer shape thereof can be disposed inside the outer shape of the shielding portion 75 when seen from the swing shaft direction of the swing shaft 652.

As a result, since the second extension portion 73 biased by the second biasing spring 792 reliably receives the drag from the print medium M after being loaded in the roll guide 60, swing of the arm portion 71 by the second biasing spring 792 can be avoided, and holding of the print medium M by the holding pin 78 can be maintained.

Moreover, such a situation can be prevented that a part of the print medium M (roll) is deflected and the suspended print medium M (sheet) is caught by the second extension portion 73 when the print medium M is taken out.

As described above, the swing member 70 (the arm portion 71, the retreating operation portion 76) is slidable with respect to the support member 65 along a sliding direction (substantially vertical direction) of the bearing portion 711 by being mounted so that the bearing portion 711 is slidable in the swing radial direction with respect to the swing shaft 652.

Thus, when the upper part of the holding pin 78 is brought into contact with the tubular material P of the print medium M and receives the load, the swing member 70 swings (moves) downward by a predetermined distance. At that time, the fitting portion 74 is brought into a state (lock state) fitted in the fitted portion 653 (see FIG. 21).

As illustrated in FIGS. 9 and 10, the retreating operation portion 76 has a head portion 771 and a constricted portion 772 in a distal end region, and a tip end of the constricted portion 772 is the head portion 771.

On the other hand, the accommodating portion 651 has a form capable of accommodating the head portion 771 and the constricted portion 772, and a lock portion 654 is provided at a position where the head portion 771 and the constricted portion 772 are accommodated.

As illustrated in FIG. 14, the lock portions 654 are provided in a pair, juxtaposed in the swing shaft direction, and disposed so that the constricted portion 772 passes between the pair of lock portions 654 when the retreating operation portion 76 (swing member 70) swings.

Moreover, the head portion 771 is formed wider than an interval between the pair of constricted portions 772 and prohibits swing of the retreating operation portion 76 (swing member 70) by abutting against the lock portion 654 (or by being disposed at a position interfering with the lock portion 654 at the swing of the retreating operation portion 76) in the aforementioned lock state.

[Operation of Roll Guide 60 (No. 1)]

FIG. 16 is a view for explaining an operation of loading/holding the print medium M in the roll guide 60 (after swing of the arm portion 71) and corresponds to FIG. 9.

Figure 17:
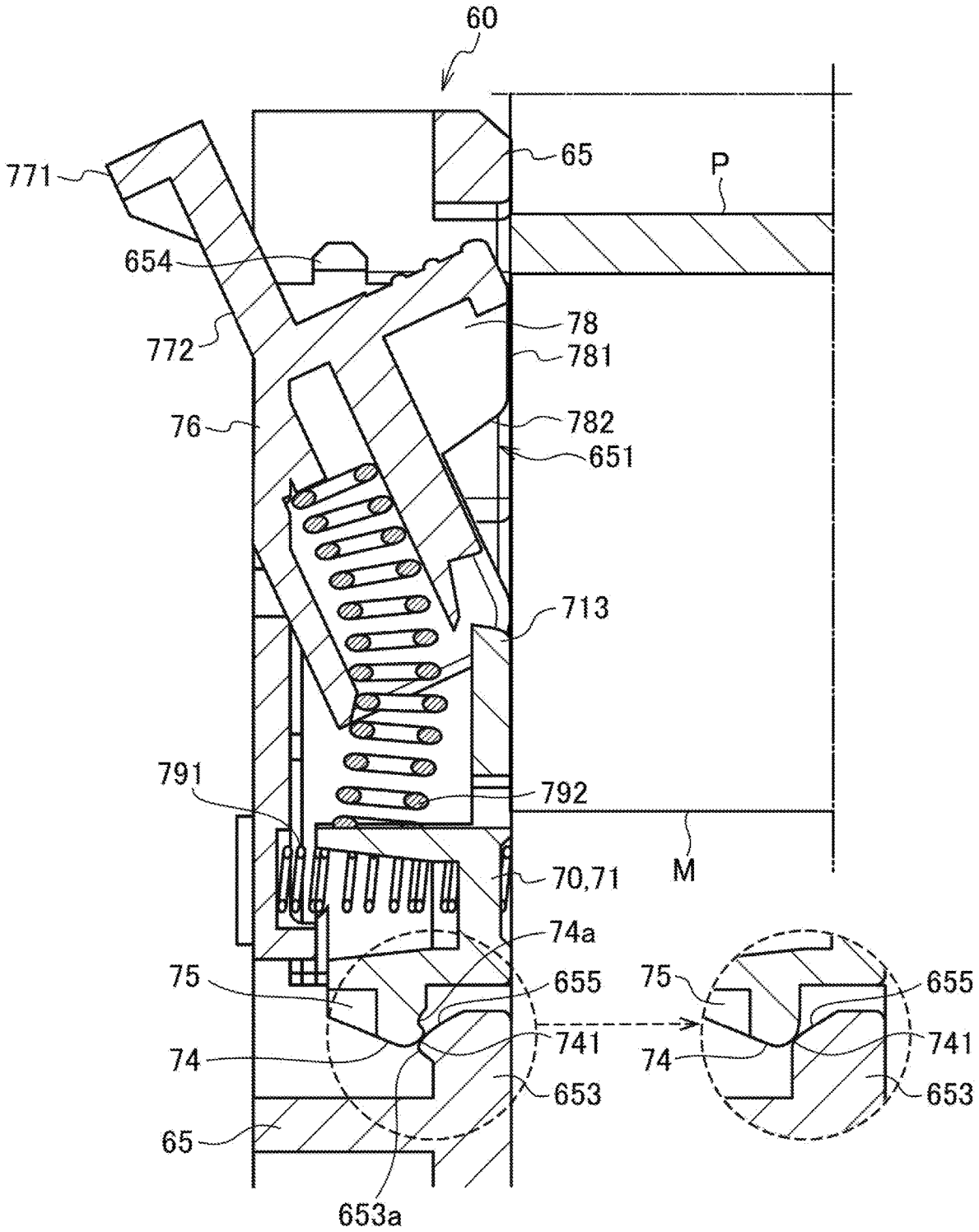
FIG. 17 is a view for explaining the operation of loading/holding of the print medium M in the roll guide 60 (after swing of the arm portion 71) and corresponds to FIG. 10

FIG. 17 is a view for explaining the operation of loading/holding the print medium M in the roll guide 60 (after swing of the arm portion 71) and corresponding to FIG. 10.

FIG. 18 is a view for explaining an operation of loading/holding the print medium M in the roll guide 60 (after swing of the retreating operation portion 76) and corresponds to FIG. 9.

FIG. 19 is a view for explaining an operation of loading/holding the print medium M in the roll guide 60 (after swing of the retreating operation portion 76) and corresponds to FIG. 10.

Figure 20:
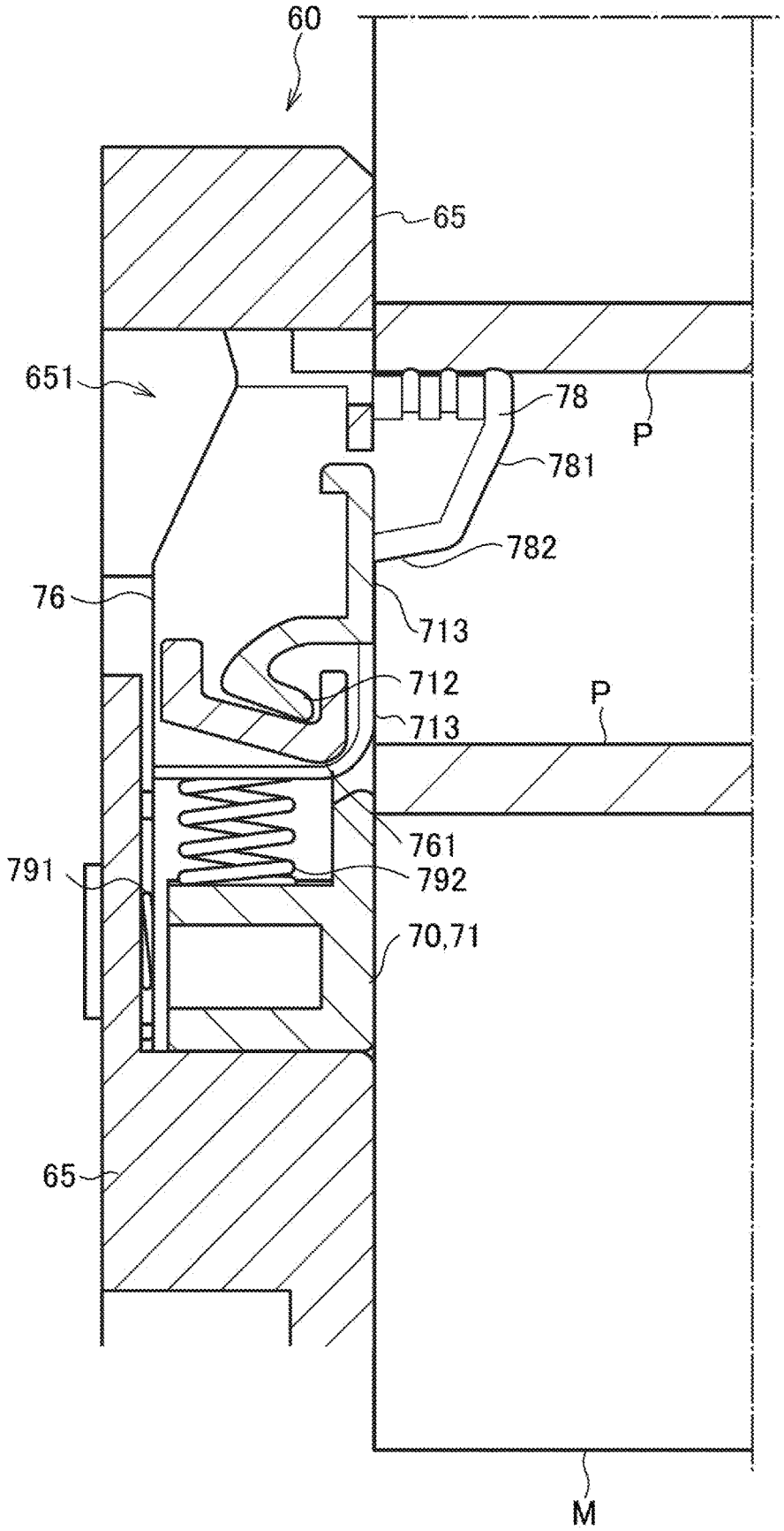
FIG. 20 is a view for explaining the operation of loading/holding of the print medium M in the roll guide 60 (after lock) and corresponds to FIG. 9.

FIG. 20 is a view for explaining an operation of loading/holding the print medium M in the roll guide 60 (after lock) and corresponds to FIG. 9.

FIG. 21 is a view for explaining an operation of loading/holding the print medium M in the roll guide 60 (after lock) and corresponds to FIG. 10.

The operation of the roll guide 60 constituting the printer 100 of this embodiment will be described.

Before the print medium M is loaded, the roll guide 60 is biased by the first biasing spring 791 as the initial state, and the pair of swing members 70 is disposed in the direction where the holding pins 78 are separated from each other (see FIGS. 7, 9, and 10).

And as illustrated in FIGS. 16 and 17, when the print medium M is started to be inserted into the roll guide 60, the print medium M is brought into contact with the swing member 70 (arm portion 71), the swing member 70 swings in the direction where holding pins 78 get closer to each other (see FIG. 7), and the distal end of the holding pin 78 is brought into contact with the end portion of the print medium M.

However, when the retreating operation portion 76 supporting the holding pins 78 relatively swings with respect to the arm portion 71, the arm portion 71 continuously swing in the state where the swing of the retreating operation portion 76 is stopped, and the surface of the arm portion 71 and the surface of the support member 65 from the substantially same plane (first swing state).

As illustrated in FIGS. 18 and 19, when the insertion of the print medium M is advanced, and the holding pin 78 is faced with the inside of the tubular material P of the print medium M, the holding pin 78 swings in the direction of entering into the tubular material P by the second biasing spring 792, and when the constricted portion 772 passes between the pair of lock portions 654, the swing advances and is brought into contact with the stopper 713, whereby the swing is stopped (second swing state).

As illustrated in FIGS. 20 and 21, when the upper part of the holding pin 78 is brought into contact with the inner wall surface on the upper side of the tubular material P, and the holding pin 78 receives a load from the print medium M, the swing member 70 including the holding pin 78 slides downward, and the fitting portion 74 (recess portion 74*a*) disposed on the arm portion 71 is fitted in the fitted portion 653 (projecting portion 653*a*) formed on the accommodating portion 651, whereby the swing of the arm portion 71 is prohibited.

An inclined surface 741 inclined to the holding region side is provided on the lower part (the end portion on the negative swing radius side) of the fitting portion 74, and an inclined surface 655 inclined to the rear surface side of the swing member 70 is provided on the lower part of the accommodating portion 651.

When the swing member 70 slides downward, the inclined surface 741 and the inclined surface 655 abut to each other (see FIG. 19), and it is constituted that the fitting portion 74 is guided by the inclined surface 741 to the fitted portion 653 located lower than the inclined surface 655.

Therefore, even if the swing of the swing member 70 is insufficient in the second swing state, the fitting portion 74 (recess portion 74*a*) can be reliably fitted in the fitted portion 653 (projecting portion 653*a*).

In FIG. 17 (first swing state) and FIG. 19 (second swing state), the inclined surface 741 is in contact with the inclined surface 655 but may be located at a position separated above the inclined surface 655.

When the fitting portion 74 is fitted in the fitted portion 653, the head portion 771 of the retreating operation portion 76 is accommodated in the accommodating portion 651 and is faced with/in contact with the lock portion 654 formed on the accommodating portion 651, whereby the swing of the retreating operation portion 76 is prohibited (lock state).

As a result, loading of the print medium M into the roll guide 60 is finished, and the print medium M is rotatably held by the holding pin 78.

Here, the retreating operation portion 76 receives the biasing force in the direction to swing to the holding region side from the second biasing spring 792 even in the lock state. Thus, when the holding pin 78 can stably enter into the tubular material P and maintain the holding of the print medium M by the biasing force from the second biasing spring 792, the lock portion 654 (see the view in the broken circle in FIG. 11) can be omitted. In this case, since the design of the support member 65 is simplified, a cost can be suppressed.

It is natural that the swing of the retreating operation portion 76 can be reliably prohibited in the lock state by applying the lock portion 654.

Moreover, as illustrated in FIG. 21 and the like, the swing of the swing member 70 (arm portion 71) is prohibited as long as the fitting portion 74 is in contact with the fitted portion 653. And in the lock state, the load of the print medium M is given to the holding pin 78 (swing member 70), and the swing member 70 (arm portion 71) is not lifted up. Therefore, the recess portion 74*a* of the fitting portion 74 and the projecting portion 653*a* of the fitted portion 653 can be omitted (see the views in the broken circles in FIGS. 10, 17, 19, and 21).

As a result, when the swing member 70 is transferred from the second swing state to the lock state, a facing surface of the fitting portion 74 with the fitted portion 653 is brought into a form in which it slides without any obstruction with respect to the facing surface of the fitted portion 653 with the fitting portion 74 and thus, the transfer from the second swing state to the lock state (or the transfer in the opposite direction) can be made smoothly.

Moreover, the head portion 771 is in a state of protruding above the support member 65 in the second swing state (see FIG. 19), but when in the lock state (see FIG. 21), it is brought into a form accommodated in the accommodating portion 651 (support member 65).

As a result, a user can check that the swing of the arm portion 71 and the retreating operation portion 76 is locked, and the print medium M is held by the holding pin 78 by whether or not the head portion 771 is accommodated in the accommodating portion 651.

To the contrary, when the print medium M is taken out of the roll guide 60, the inner wall surface on the lower side of the tubular material P of the print medium M is brought into contact with the inclined surface 782 of the holding pin 78 (see FIGS. 18 and 19) and when the print medium M lifts up the holding pin 78, the swing member 70 slides upward, and the head portion 771 protrudes from the upper part of the support member 65 at this time.

When the head portion 771 becomes higher than the lock portion 654, the retreating operation portion 76 becomes capable of swing with respect to the arm portion 71. At the same time, the fitting of the fitting portion 74 is disengaged, the arm portion 71 becomes capable of swing, and the arm portion 71 swings and abuts against the print medium M by the biasing force of the first biasing spring 791 (second swing state).

After that, as the print medium M is lifted up, the swing of the swing member 70 by the first biasing spring 791 advances, and the holding pin 78 does not protrude from the surface of the support member 65 anymore, whereby the print medium M can be taken out of the roll guide 60 easily.

When the print medium M has been taken out, the swing member 70 returns to the initial state.

In the second swing state, when the user causes the head portion 771 to swing to the rear side of the support member 65 and causes the holding pin 78 to retreat to the accommodating portion 651, the print medium M can be also taken out of the roll guide 60.

In this embodiment, the holding pin 78 does not protrude to the holding region of the print medium M from the support member 65 immediately after the swing member 70 swings in loading of the print medium M but is operated so as to enter into the tubular material P for the first time at a stage faced with the inside of the tubular material P of the print medium M.

Moreover, the swing member 70 is disposed by being biased to the upper end side on the support member 65, and a space for holding the print medium M (holding region) is ensured below the swing member 70 (see FIGS. 7 and 8).

Thus, in this embodiment, even if the diameter of the print medium M is considerably larger than the length of the swing member 70 (arm portion 71) in the swing radial direction, the print medium M can be reliably loaded/held.

Moreover, the length of the swing member 70 (arm portion 71) in the swing radial direction is preferably designed to be smaller (a half or less, for example) than the length of the support member 65 in the vertical direction.

As a result, the distance between the contact position between the swing member 70 and the print medium M and the holding pin 78 can be made smaller, and the print medium M with a small inner diameter of the tubular material P can be also reliably loaded/held.

[Operation of roll guide 60 (No. 2)]

Figure 23:
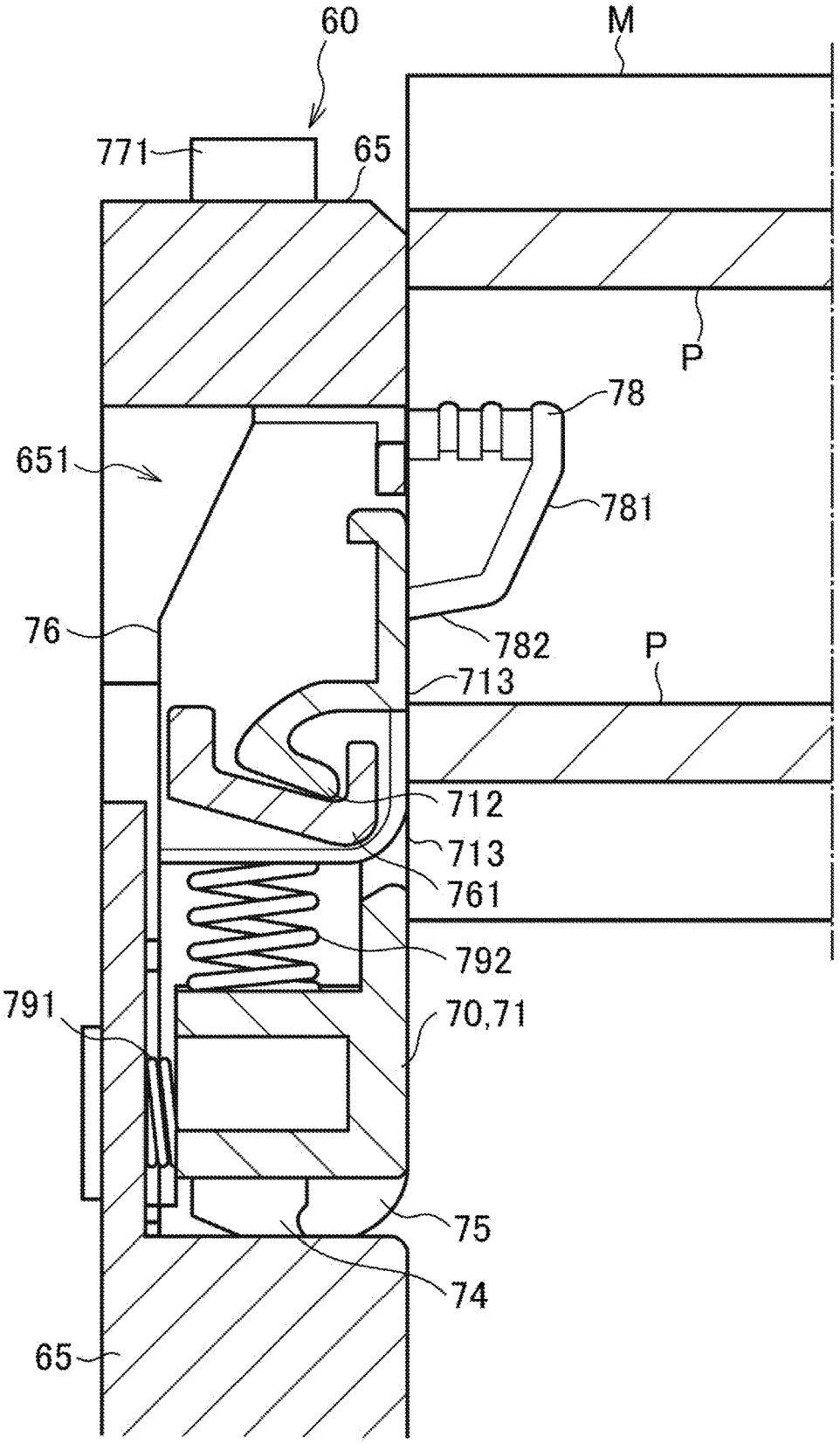
FIG. 23 is a view for explaining the operation of loading/holding the print medium M with a small diameter in the roll guide 60 (after swing of the swing member 70) and corresponds to FIG. 9.

FIG. 23 is a view for explaining the operation of loading/holding the print medium M with a small diameter in the roll guide 60 (after swing of the swing member 70) and corresponds to FIG. 9.

Here, the operation when the holding pin 78 is faced with the inside of the tubular material P of the print medium M at a stage in which a remaining amount of the print medium M (sheet) is small, and the print medium M is brought into contact with the swing member 70 (arm portion 71) will be described.

As illustrated in FIG. 23, when the print medium M is brought into contact with the arm portion 71, the holding pin 78 is faced with the inside of the tubular material P and thus, the retreating operation portion 76 swings with the arm portion 71, and the holding pin 78 enters into the tubular material P as it is. After that, the operation similar to the operations illustrated in FIGS. 20 and 21 is performed.

Moreover, when the print medium M is taken out, the swing of the arm portion 71 by the fitting portion 74 and the swing of the retreating operation portion 76 by the lock portion 654 are allowed, and the arm portion 71 is immediately brought into a state separated from the print medium M and thus, the arm portion 71 and the retreating operation portion 76 swing by the first biasing spring 791 and return to the initial state.

Thus, in this embodiment, even if the print medium M is in the state where the remaining amount of the print medium M (sheet) is small, it can be reliably loaded/held.

In the layout of the swing member 70 and the swing shaft 652 in the initial state, if the design is such that the center of gravity of the swing member 70 in the swing radial direction is disposed at a position higher than the swing shaft 652, whereby the upper part of each of the swing members 70 swings in the direction separated from the holding region by the gravity and the pair of holding pins 78 swings in the direction separated from each other, for example, the first biasing spring 791 (first biasing means) can be omitted.

Moreover, when the print medium M is to be loaded, it is brought into contact with (pressed to) the lower part of the swing member 70, whereby the swing member 70 swings easily in the direction where the pair of holding pins 78 gets closer to each other, for example, and when the print medium M is to be taken out, the tubular material P of the print medium M is brought into contact with (pressed to) the holding pin 78 (inclined surface 781), whereby the swing member 70 easily swings in the direction where the pair of holding pins 78 is separated from each other, the first biasing spring 791 (first biasing means) can be omitted.

Figures 1, 24:
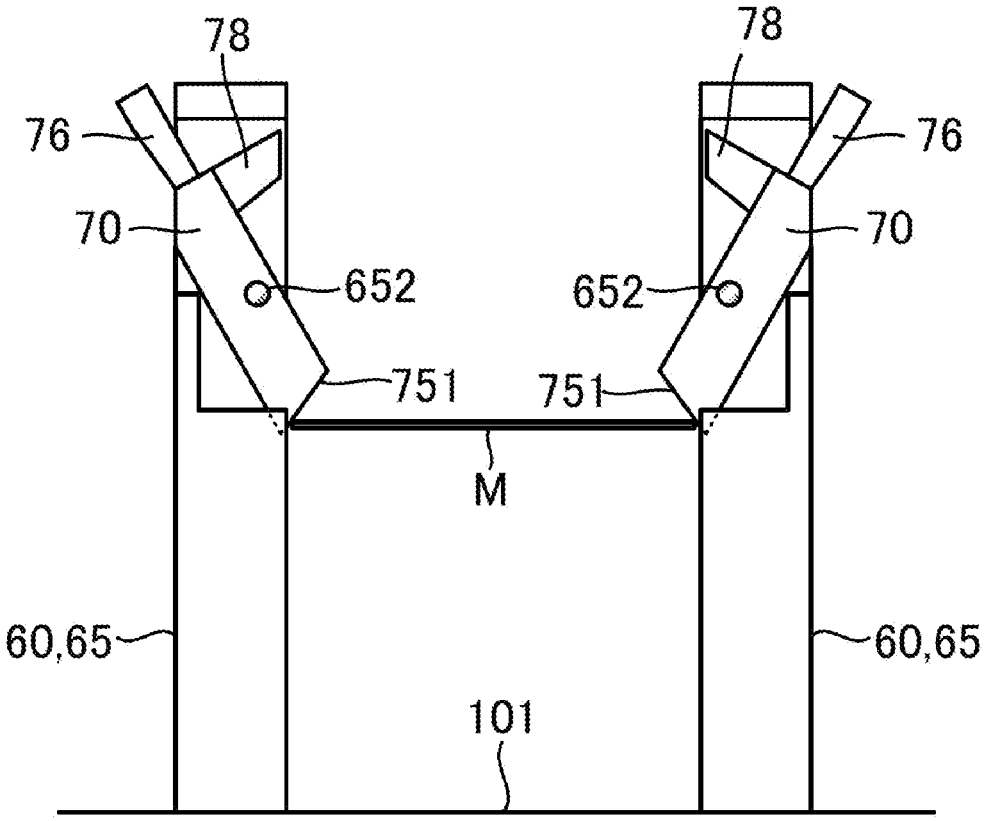
Figures 2, 24:
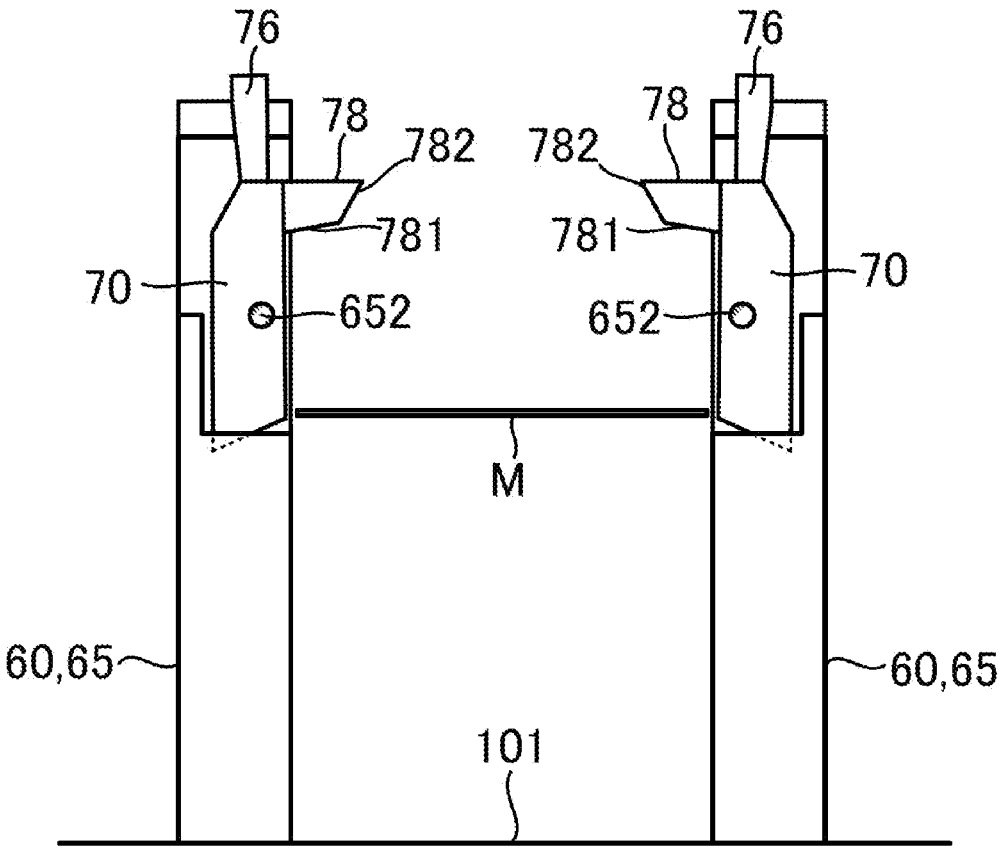
Figures 3, 24:
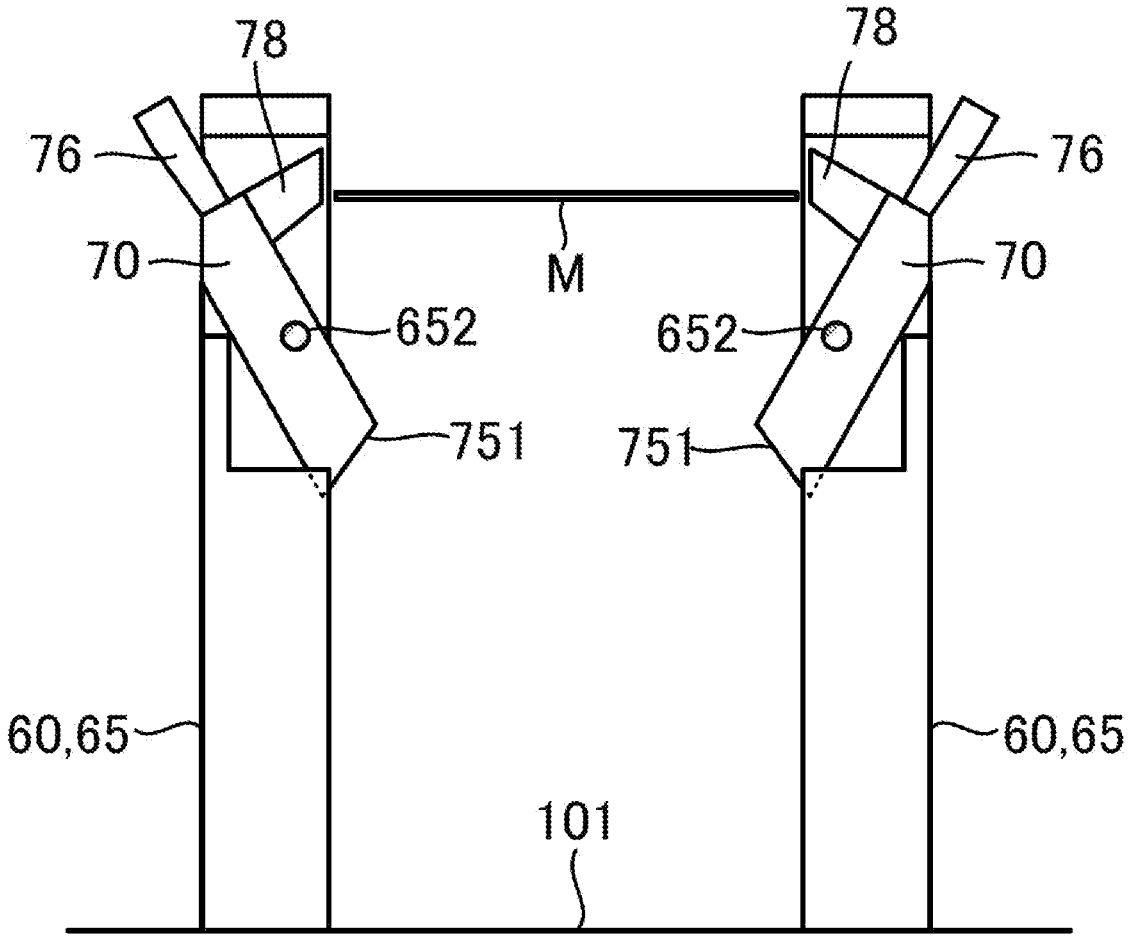

FIG. 24-1 is a view illustrating the operation of the swing member 70 when the print medium M (sheet) is taken out of the roll guide 60 and illustrates a case when the print medium M (sheet) is brought into contact with the inclined surface 751. FIG. 24-2 is a view illustrating the operation of the swing member 70 when the print medium M (sheet) is taken out of the roll guide 60 and illustrates a case when the inclined surface 751 receives a force from the print medium M (sheet), and the swing member 70 swings in the direction where the pair of holding pins 78 get closer to each other by using the wedge effect of the inclined surface 751. FIG. 24-3 is a view illustrating the operation of the swing member 70 when the print medium M (sheet) is taken out of the roll guide 60 and illustrates a case when the swing member 70 swings in the direction where the print medium M (sheet) is brought into contact with the holding pin 78, and the pair of holding pins 78 is separated from each other.

When the first biasing spring 791 is omitted or when the biasing force of the first biasing spring 791 is small, the operation of the swing member 70 when the print medium M is to be taken out of the roll guide 60, and a part of the print medium M (roll) is deflected and there is the suspended print medium M (sheet) will be described.

In this case, when the print medium M (roll) (see FIG. 7) is lifted up, first, the swing member 70 swings in the direction where the pair of holding pins 78 is separated from each other, and the inclined surface 751 of the swing member 70 protrudes to the holding region side from the support member 65.

At this time, as illustrated in FIG. 24-1, the lower end (a broken line portion in FIG. 24-1) of the swing member 70 (inclined surface 751) is disposed on a more inner side than the support member 65 when seen from the swing shaft direction, and a state where the surface of the support member 65 on the holding region side and the inclined surface 751 cross each other at an obtuse angle (90 degrees or more) is maintained, and a step is not formed between the support member 65 and the swing member 70. Thus, such a situation that the lower end of the swing member 70 (inclined surface 751) is caught by the print medium M (sheet), whereby the swing member 70 swings in the direction where the pair of holding pins 78 is separated from each other, and the swing member 70 interferes with the print medium M (sheet) can be avoided.

Thus, as illustrated in FIG. 24-1, when the print medium M (roll) (not shown in FIGS. 24-1, 24-2, and 24-3) is further lifted up, the print medium M (sheet) is brought into contact with the inclined surface 751.

Then, as illustrated in FIG. 24-2, the inclined surface 751 (swing member 70) receives the force from the print medium M (sheet) and is pushed into the support member 65 side by the so-called wedge effect, and the swing member 70 swings in the direction where the pair of holding pins 78 gets closer to each other around the swing shaft 652 as the shaft.

Moreover, when the print medium M (roll) is lifted up, the print medium M (sheet) is brought into contact with the inclined surface 781 of the holding pin 78. At this time, the inclined surface 781 (holding pin 78) is pushed into the support member 65 side from the print medium M (sheet), and the swing member 70 swings in the direction where the pair of holding pins 78 is separated from each other this time around the swing shaft 652 as the shaft.

Moreover, when the print medium M (roll) is further lifted up, the print medium M (sheet) is brought into contact with the inclined surface 782 of the holding pin 78. At this time, the inclined surface 782 (holding pin 78) is further pushed into the support member 65 side from the print medium M (sheet), and the swing member 70 further swings in the direction where the pair of holding pins 78 is separated from each other.

Thus, as illustrated in FIG. 24-3, since the holding pin 78 is pushed into the support member 65, the print medium M can be taken out of the roll guide 60 easily without having the print medium M (sheet) caught by the swing member 70 and the holding pin 78.

In a case where the first biasing spring 791 is provided, if its biasing force is small, when the print medium M (sheet) is brought into contact with the inclined surface 751, the inclined surface 751 (swing member 70) receives the force from the print medium M (sheet) regardless of the biasing force of the first biasing spring 791 and is pushed into the support member 65 side by the so-called wedge effect, and the swing member 70 swings in the direction where the pair of holding pins 78 gets closer to each other. Then, at the stage where the print medium M (sheet) has passed the inclined surface 751, the swing member 70 begins to swing in the direction where the pair of holding pins 78 is separated from each other, and the swing is completed at the stage of reaching the vicinity of the swing shaft 652 (see FIG. 24-3).

As described above, the print medium M (sheet) can be prevented from being caught when the print medium M is taken out regardless of presence of the first biasing spring 791. Moreover, after the print medium M is taken out, since the swing member 70 returns to the initial stage, loading of the subsequent print medium M can be also performed easily.

It is natural that the operation of causing the swing member 70 to swing in the direction where the pair of holding pins 78 is separated from each other can be performed stably by applying the first biasing spring 791 (first biasing means) to this embodiment.

[Effect of this Embodiment]

As described above, the printer 100 of this embodiment includes the pair of support members 65 sandwiching the roll-like print medium M and the pair of swing members 70 including the holding pins 78 for rotatably holding the print medium M, mounted on the support members 65, capable of swing, respectively, and swinging in the direction where the pair of holding pins 78 gets closer to each other by abutting to the print medium M, and the swing member 70 is mounted at a position biased to the taking-out direction side of the print medium M in the support member 65, and the length of the swing member 70 in the swing radial direction is smaller than the length of the support member 65 in the taking-in/out direction of the print medium M.

By means of the aforementioned configuration, the swing member 70 is mounted at the position biased to the upper end side of the support member 65. As a result, even the large print medium M having the length from the swing member 70 to the lower part of the support member 65 as the radius can be loaded/held.

Moreover, since the length of the swing member 70 in the swing radial direction is smaller than the length of the support member 65 in the vertical direction (a half or less, for example), the distance between the contact position with the print medium M of the swing member 70 and the holding pin 78 can be made smaller, and the print medium M with the small inner diameter of the tubular material P can be also reliably loaded/held.

In this embodiment, the first biasing spring 791 (first biasing means) for giving the biasing force to the swing member 70 to swing in the direction where the pair of holding pins 78 is separated from each other is included.

As a result, the operation of causing the swing member 70 to swing in the direction where the pair of holding pins 78 is separated from each other can be performed stably.

In this embodiment, the swing member 70 includes the arm portion 71 (swing member body), the retreating operation portion 76 for retreating the holding pin 78 to the direction not protruding from the arm portion 71 (swing member body) by using the reaction force when the holding pin 78 is brought into contact with the print medium M as the swing of the arm portion 71 (swing member body) in contact with the print medium M, and the second biasing spring 792 (second biasing means) for giving the biasing force to the retreating operation portion 76 to the direction where the holding pin 78 protrudes from the arm portion 71 (swing member body).

By means of the aforementioned configuration, when the swing member 70 swings, and the holding pin 78 is brought into contact with the end surface of the print medium M when the print medium M is to be inserted into the roll guide 60, the retreating operation portion 76 relatively swings to the direction where the holding pin 78 is withdrawn to the arm portion 71 (swing member 70) side by using the reaction force when the holding pin 78 is brought into contact with the print medium M.

As a result, even in the state where the holding pin 78 is in contact with the print medium M, the arm portion 71 (swing member 70) can continuously swing.

After that, when the holding pin 78 is faced with the inside of the tubular material P of the print medium M, the second biasing spring 792 causes the retreating operation portion 76 and the holding pin 78 to swing in the direction to protrude from the surface of the arm portion 71 (swing member 70) and thus, the holding pin 78 can be reliably made to enter into the tubular material P.

Moreover, when the remaining amount of the print medium M (sheet) becomes small, and the diameter of the print medium M (roll) becomes smaller, the holding pin 78 can be made to reliably enter into the tubular material P without operation of the retreating operation portion 76.

As a result, the printer 100 including the roll guide 60 which can load and hold the print medium M regardless of the diameter of the print medium M and the diameter of the tubular material P of the print medium M can be provided.

As described above, the embodiment of the present invention has been described, but the aforementioned embodiment only illustrates one of the application examples of the present invention and is not intended to limit the technical range of the present invention to the specific configuration of the aforementioned embodiment.

The printer 100 may be ones performing print by an inkjet method, a thermal transfer method and the like, for example.

The present application claims for priority based on the Japanese Patent Application No. 2018-068318 filed on the Japan Patent Office on Mar. 30, 2018, and the entire contents of this application are incorporated in this description by reference.

The invention claimed is:

1. A printer comprising:

first and second support members configured to sandwich a roll-like print medium;

a first swing member mounted on the first support member to swing around a first swing- member axis;

a second swing member mounted on the second support member to swing around a second swing-member axis;

the first swing member including a first holding pin configured to hold the print medium and swing around a first holding-pin fulcrum, the second swing member including a second holding pin configured to hold the print medium and swing around a second holding-pin fulcrum, the first swing-member axis being different from the first holding-pin fulcrum and the second swing-member axis being different from the second holding-pin fulcrum.

2. A printer as set forth in claim 1, wherein each swing member of the first and second swing members is mounted in the respective support member at a position biased to a taking-out direction side of the print medium; and a length of each swing member of the first and second swing members in a swing radial direction is smaller than a length of the respective support member in the taking-out direction.

3. A printer as set forth in claim 1, wherein each swing member of the first and second swing members is further configured to move in a linear direction.

4. A printer as set forth in claim 1, wherein each swing member of the first and second swing members has an initial contact point of the print medium below the respective swing-member axis.

5. A printer as set forth in claim 1, wherein the first swing member has an initial contact point of the print medium spaced from the first swing-member axis by a first distance and the first holding pin is spaced from the first swing-member axis by a second distance, the first distance being smaller than the second distance.

6. A printer as set forth in claim 1, wherein the first support member and the first swing member are configured to lock the first swing member.

* * * * *